US006634741B2

(12) United States Patent
Kataoka et al.

(10) Patent No.: US 6,634,741 B2
(45) Date of Patent: Oct. 21, 2003

(54) INK JET RECORDING HEAD, INK JET RECORDING DEVICE AND HEAD MANUFACTURING METHOD

(75) Inventors: Masaki Kataoka, Ebina (JP); Kazuyuki Oda, Ebina (JP); Michiaki Murata, Ebina (JP); Yoshihisa Ueda, Ebina (JP); Toshimichi Iwamori, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/844,222

(22) Filed: Apr. 30, 2001

(65) Prior Publication Data

US 2001/0055053 A1 Dec. 27, 2001

(30) Foreign Application Priority Data

May 1, 2000 (JP) ..... 2000-133027

(51) Int. Cl.[7] ..... B41J 2/19
(52) U.S. Cl. ..... 347/92
(58) Field of Search ..... 347/63, 65, 66, 347/86, 92, 94

(56) References Cited

U.S. PATENT DOCUMENTS 5,479,196 A * 12/1995 Inada ..... 347/92
5,777,649 A * 7/1998 Otsuka et al. ..... 347/94
5,808,643 A * 9/1998 Tracy et al. ..... 347/92
5,831,653 A * 11/1998 Brandon et al. ..... 347/87
5,969,738 A * 10/1999 Tomikawa et al. ..... 347/86
6,003,986 A * 12/1999 Keefe ..... 347/92

FOREIGN PATENT DOCUMENTS

| | | |
|---|---|---|
| JP | 6-183002 | 7/1994 |
| JP | 9-226142 | 9/1997 |
| JP | 9-327921 | 12/1997 |
| JP | 10-76650 | 3/1998 |
| JP | 2888474 B2 | 2/1999 |
| JP | 11-24513 | 9/1999 |

* cited by examiner

*Primary Examiner*—Anh T. N. Vo
(74) *Attorney, Agent, or Firm*—Morgan Lewis & Bockius LLP

(57) ABSTRACT

The present invention provides an ink jet recording head that enables stable high-speed continuous printing, its manufacturing method and an ink jet recording device. A bubble generated in a common liquid chamber is moved to the side of an ink tank via a communicating port formed in a sufficient size and a supply passage. That is, a bubble generated inside a common liquid chamber is exhausted satisfactorily from the common liquid chamber by forming the communicating port in a shape which the bubble can pass, resulting in the supply of ink to the common liquid chamber and an individual passage (nozzle) prevented from being blocked by the bubble. As a result, even if high-speed continuous jetting (printing) is performed, stable printing is enabled.

16 Claims, 19 Drawing Sheets

SIGNAL PROCESSING CIRCUIT
DRIVER CIRCUIT 126
122
124
108
128

128
130

102
120
106
104
110
132

132
134

132

128
B
120
110
100
132
130
104
126

INK JET RECORDING HEAD, INK JET RECORDING DEVICE AND HEAD MANUFACTURING METHOD

BACKGROUND OF THE INVENTION

1. Field of the Invention

The present invention relates to an ink jet recording head that jets ink droplets on a record medium to form an image, an ink jet recording device and a head manufacturing method.

2. Description of the Related Art

Recently, an ink jet recording device is drawing attention as a low-cost quality color recording device. For an ink jet recording head of an ink jet recording device, there are known a piezoelectric type ink jet recording head that jets ink from a nozzle by pressure generated by mechanically deforming a pressure chamber by a piezoelectric material for example and a thermal ink jet recording head that energizes a heater element arranged in an individual passage and jets ink from a nozzle by pressure acquired by vaporizing ink.

For a current thermal ink jet recording head, there is known an ink jet recording head disclosed in Japanese Published Unexamined Patent Application No. Hei 9-226142 (hereinafter called a conventional example 1), Japanese Published Unexamined Patent Application No. Hei 10-76650 (hereinafter called a conventional example 2), Japanese Published Unexamined Patent Application No. Hei 9-327921 (hereinafter called a conventional example 3) and others.

Referring to FIGS. 20 to 23, an ink jet recording head in the conventional example 1 will be described below. FIG. 20 is a perspective view showing an example of the ink jet recording head and an ink supply part respectively mounted in a conventional type ink jet recording device and FIG. 21 is a sectional view viewed along the line B—B in FIG. 20.

As shown in FIGS. 20 and 21, plural individual passages 102 are formed in a head chip 100 and a nozzle 104 for jetting ink is formed at the end of each individual passage. The plural individual passages 102 communicate with a common liquid chamber 106 inside. Each heater element 108 is provided on the plural individual passages 102, ink in the individual passage 102 foams by heat generated by the heater element 108 and recording is performed by jetting ink from the nozzle 104 by pressure acquired by foaming. Also, the common liquid chamber 106 is provided with a communicating port 110 for supplying ink from the outside.

An ink supply member 112 is arranged on the upside of the head chip 100. The ink supply member 112 is provided with an ink passage pipe 114 for supplying ink supplied from an ink tank not shown to the head chip 100. A filter may be inserted between the ink tank and the ink passage pipe 114 to filter minute solid matters in ink so that they are prevented from entering the head chip 100 to prevent blocking of a nozzle.

The head chip 100 is formed by bonding a passage substrate 120 where the individual passage 102, the common liquid chamber 106 and others are formed and a heater element substrate 126 where the heater element 108, a signal processing circuit 122 for driving the heater element 108 and a driver circuit 124 are formed as shown in FIG. 22.

Referring to FIG. 22, a method of producing the head chip 100 made up as described above will be described below.

For a method of producing the heater element substrate 126, technology for manufacturing LSI and its production facilities for example can be used. A heat storage layer, an exothermic layer to be the heater element, a protective layer for preventing the heater element from being broken by the pressure of bubbles generated by the heat of the heater element and others are laminated on a monocrystalline silicon wafer 128 as shown in FIG. 22A. Further, for a protective layer to protect from ink, a resin layer 130 made of photosensitive polyimide for example is laminated as shown in FIG. 22B.

In the meantime, for the passage substrate 120, grooves to be the common liquid chamber 106 and the individual passages 102 and others can be formed on a silicon wafer 132 by anisotropic etching for example as shown in FIG. 22C. For a method of forming the grooves to be the common liquid chamber 106 and the individual passages 102 and others by anisotropic etching, after an etching mask is patterned on a silicon wafer which has a crystal face of <100> on the surface, etching has only to be performed using the heated aqueous solution of potassium hydroxide (KOH) as disclosed in Japanese Published Unexamined Patent Application Nos. Hei 11-245413 and Hei 6-183002. The grooves to be the common liquid chamber 106 and the individual passages 102 and others formed using anisotropic etching become grooves having a desired angle as shown in FIG. 23.

Further, after two silicon wafers 128 and 132 are bonded with a resin layer 130 between them as shown in FIG. 22E after an adhesive 134 is applied on the silicon wafer 132 as shown in FIG. 22D, the two silicon wafers are diced and isolated according to a method described in Patent No. 2888474 and others and multiple head chips 100 are simultaneously manufactured as shown in FIG. 22F.

Afterward, the head chip 100 is fastened to a heat sink for outgoing radiation 136 as shown in FIGS. 20 and 21. On the heat sink 136, a printed wiring substrate 138 is also formed, power and a signal supplied from the body of the ink jet recording device are transmitted to the heater element substrate 126 via bonding wire 140 and a signal and others from various sensors provided to the heater element substrate 126 are transmitted to the body of the recording device.

The head chip 100 and the ink supply member 112 are bonded by an adhesive 142.

Ink is supplied from the ink tank to the ink jet recording head 144 manufactured as described above. Ink supplied from the ink tank flows in the ink passage pipe 114 in the ink supply member 112, enters the common liquid chamber 106 in the head chip via the communicating port (the inlet) 110 open on the upside of the passage substrate 120 of the head chip 100 and is supplied to each individual passage 102.

Next, referring to FIGS. 24 and 25, a conventional example 2 will be described. The same reference numbers are allocated to the same components for those in the conventional example 1 and a detailed description is omitted.

In the conventional example 2, an ink passage pipe 114 connecting the ink tank with a common liquid chamber 106 is integrated with a nozzle top plate 150 to which individual passages (grooves) 102 are provided. Therefore, in the conventional example 2, ink supplied to the common liquid chamber 106 via a communicating port not shown at the end of the ink passage pipe 114 also reaches the individual passage (groove) 102 and is also jetted from a nozzle 104, as in the conventional example 1.

Next, referring to FIGS. 26 and 27, the conventional example 3 will be described. The same reference numbers are allocated to the same components for those in the conventional example 1 and a detailed description is omitted.

The conventional example 3 relates to an ink jet recording head called a roof type in which ink supplied from a communicating port 110 flows in an approximately perpendicular direction along a plane 108A of a heating element 108 from a common liquid chamber 106 and is jetted from a nozzle 104 in a direction approximately perpendicular to the plane 108A as shown in FIGS. 26 and 27.

In the ink jet recording head 14 in the conventional example 1, when bubbles are left in the ink passage pipe 114 and the common liquid chamber 106, the bubbles grow while the head is used and may cause a large record defect because they block the supply of ink to each individual passage 102. Particularly, in a thermal ink jet recording head, as the temperature of ink rises due to heating of a heater element, air dissolved in the ink is deposited and the growth of a bubble in the common liquid chamber 106 is accelerated. As bubbles are grown by heat as described above, bubbles are easily grown in the common liquid chamber 106 which is in contact with a heater element substrate 126 and in a connection of the common liquid chamber 106 with an ink supply part 112.

Bubbles are not only separated by heat but enter from the ink tank with ink in supplying ink and may enter from the nozzle 104 in printing. These bubbles often concentratedly stay particularly in a region (hereinafter called a dead water region. See S in FIG. 21) where ink slightly flows in the common liquid chamber of the head chip 100. These bubbles block satisfactory printing not only in a thermal ink jet recording head but all ink jet recording heads. For example, in a piezoelectric type ink jet recording head, since even a minute bubble blocks the transmission of pressure, it often causes a significant printing defect.

The conventional examples 2 and 3 also have a problem that a dead water region S (see FIGS. 25 and 27) respectively exists in the common liquid chamber 106 and bubbles easily stay as in the conventional example 1.

As described above, for a method of exhausting bubbles staying in the dead water region S in the common liquid chamber 106, generally they are sucked from the nozzle 104. When bubbles are sucked from the nozzle 104, ink of quantity corresponding to sucked quantity is supplied from the ink tank. The supplied ink is spread along the shape of the common liquid chamber 106, is led to the individual passage 102, bubbles also proceed to the individual passage 102 together with the flow of ink and are exhausted outside from the nozzle 104 together with the ink.

However, as bubbles staying at both ends of the common liquid chamber 106 which mainly cause a defect of the quality of an image exist in a region in which the flow of ink is extremely small, it is difficult to remove them completely. Therefore, a dummy nozzle 104A apart from nozzles for printing is provided at both ends of the common liquid chamber 106 and the expulsion of bubbles at both ends has to be more effective. Also, it is also conceivable that a frequency by which the nozzle is sucked is increased, however, there is a problem that as the frequent sucking is improved, the efficiency when ink is used for printing is deteriorated and the capacity of a waste ink tank for storing sucked waste ink has to be increased to result in a large-sized device.

Further, the ink jet recording head has a problem that if continuous jetting and printing are performed, the temperature of the head rises and the stable jetting of ink is disabled. In order to avoid this state, it is necessary to monitor control that the temperature of the head, and to holt printing or reduce printing speed when the temperature exceeds a certain temperature.

SUMMARY OF THE INVENTION

The invention has been made to solve the above problems and provides an ink jet recording head wherein bubbles that cause printing failure are exhausted by a simple configuration, unnecessary consumption of ink is reduced to a minimum and stable continuous printing is enabled, an ink jet recording device and a head manufacturing method.

According to an aspect of the present invention, the ink jet recording head includes individual passages communicating with a nozzle for jetting ink droplets, a common liquid chamber communicating with each individual passage, an ink chamber for supplying ink to the common liquid chamber and a communicating passage connecting the common liquid chamber and the ink chamber. The communicating passage is formed to enable at least a bubble in size that causes a printing defect to be moved from the common liquid chamber to the ink chamber.

Of bubbles existing in the common liquid chamber, when bubbles that may cause a printing defect rise by buoyancy, they can be securely moved from the common liquid chamber to an ink tank via the communicating passage. Therefore, a printing defect can be prevented because the bubbles stay in the common liquid chamber.

According to another aspect of the present invention, the ink jet recording head includes individual passages communicating with a nozzle for jetting ink droplets, a common liquid chamber communicating with each individual passage, an ink chamber for supplying ink to the common liquid chamber and a communicating passage connecting the common liquid chamber with the ink chamber. When the jetting rate D of the ink jet recording head is $D \geqq 0.05$, the communicating passage having a minimum width L that satisfies the following expression (2) for a bubble that satisfies the following expression (1) is formed.

$$\{(n \times V \times f \times D/S)^2 \times Cd \times \rho \times \pi \times d^2\}/8 < (\rho \times g \times \pi \times d^3)/6 \quad (1)$$

$$d < L \quad (2)$$

Here, n denotes the number of nozzles, V denotes the volume of an ink droplet jetted from the ink jet recording head, f denote a maximum printing frequency, D denotes a jetting rate, S denotes the minimum cross section of the communicating passage, Cd denotes a resistance coefficient, ρ denotes the density of ink, d denotes the diameter of a bubble, g denotes a gravitational constant and L denotes the minimum width of the communicating passage.

The invention proposes a bubble expulsion method different from a conventional type method and is intended to make bubbles that are generated and grow in the common liquid chamber escape into an ink tank that has no effect upon printing by the buoyancy of the bubbles themselves.

That is, in the ink jet recording head, if the minimum cross section of the communicating passage is S, the volume of an ink droplet jetted from the head is V, a maximum printing frequency is f, the number of nozzles is n, the jetting rate is D, the density of ink is ρ, a gravitational constant is g, a resistance coefficient is Cd, the diameter of a bubble is d and the minimum width of the communicating passage is L, then the buoyancy of a bubble d in diameter can be expressed as follows.

$$(\rho \times g \times \pi \times d^3)/6$$

In the meantime, the maximum flow velocity of ink in the communicating passage from the ink tank to the common liquid chamber (the flow velocity of ink in a region of which the minimum cross section is S in the communicating passage) can be expressed as follows.

$$n \times V \times f \times D/S$$

The resistance that acts upon a bubble according to this flow velocity can be expressed as follows.

$$\{(n \times V \times f \times D/S)^2 \times Cd \times \rho \times \pi \times d^2\}/8$$

That is, assuming that the average jetting rate in printing a normal text image is 5% or more, it can be said that the buoyancy of a bubble d in a diameter that satisfies the following relationship excels the resistance.

$$D \geqq 0.05$$

$$\{(n \times V \times f \times D/S)^2 \times Cd \times \rho \times \pi \times d^2\}/8 < (\rho \times g \times \pi \times d^3)/6$$

Therefore, if the ink jet recording head is formed so that the minimum width L of the communicating passage satisfies the relationship d<L between the minimum width L and the diameter d of the bubble, the bubble can be exhausted from the head (the common liquid chamber) to the ink chamber via the communicating passage.

The minimum width L of the communicating passage means the minimum one of the maximum inscribed circuits inscribed on the wall of the communicating passage at the cross section of the communicating passage.

Therefore, a bubble rising from the common liquid chamber by buoyancy can be securely moved into the ink tank. As a result, ink supply failure to the individual passage by the growth of a bubble in the common liquid chamber can be prevented and the generation of a void in a block unrecoverable of itself can be avoided. Therefore, stable ink supply is enabled and continuous printing is enabled.

As the movement of a bubble is difficult if the bubble adheres to the wall in the communicating passage, it is suitable that the following fixed margin is added (coefficient: 3).

$$d < L/3$$

If the width is set like this, bubbles can more securely pass even if they adhere to the walls on both sides. Needless to say, when a path is curved and there is a long path to go through, it is desirable that the coefficient is further increased.

According to another aspect of the present invention, the ink jet recording head includes individual passages communicating with a nozzle for jetting ink droplets, a common liquid chamber communicating with each individual passage, an ink chamber for supplying ink to the common liquid chamber and a communicating passage connecting the common liquid chamber with the ink chamber. When the jetting rate D of the ink jet recording head is D≧0.05, the communicating passage having the minimum cross section S that satisfies the following expression (4) for a bubble having the relationship expressed in the following expression (3) is formed.

$$d \geqq 2Np \quad (3)$$

$$\{(n \times V \times f \times D/S)^2 \times Cd \times \rho \times \pi \times d^2\}/8 < (\rho \times g \times \pi \times d^3)/6 \quad (4)$$

Here, n denotes the number of nozzles, V denotes the volume of an ink droplet jetted from the ink jet recording head, f denotes a maximum printing frequency, D denotes the jetting rate, S denotes the minimum cross section of the communicating passage, Cd denotes a resistance coefficient, ρ denotes the density of ink, d denotes the diameter of a bubble, g denotes a gravitational constant and Np denotes pitch between nozzles.

When a bubble of a diameter equivalent to nozzle pitch Np of two or more blocks the individual passage, no ink droplet is jetted from adjacent two or more nozzles and as a result, printing is disabled. Then, if a bubble (d>2Np) the diameter of which is equivalent to pitches Np of two or more satisfies the above expression (4), the buoyancy of the bubble excels resistance and the bubble can be moved by buoyancy via the communicating passage.

Therefore, blocking adjacent plural nozzles and from causing a printing defect by a bubble is prevented by forming the communicating port having the minimum cross section S that satisfies this relationship. Therefore, an image having high reliability can be continuously formed.

According to another aspect of the present invention, the ink jet recording device includes an individual passage communicating with a nozzle for jetting ink droplets, a common liquid chamber communicating with each individual passage, an ink chamber for supplying ink to the common liquid chamber and plural communicating passages each of which connects the common liquid chamber with the ink chamber. For at least one communicating passage, an ink supply direction from the ink chamber to the common liquid chamber is set within a range of 45° from the downside in a gravitational direction in.

If a bubble caused in the common liquid chamber rises by buoyancy when the ink supply direction from the ink chamber to the common liquid chamber is set in a range of 45° from the downside in a gravitational direction, the bubble can be guided from the common liquid chamber to the ink chamber. Therefore, occurrences of printing failure by bubbles can be satisfactorily inhibited.

BRIEF DESCRIPTION OF THE DRAWINGS

Preferred embodiments of the invention will be described in detail based on the followings, wherein.

DETAILED DESCRIPTION OF THE PREFERRED EMBODIMENTS (First Embodiment)

Referring to FIGS. 1 to 5, an ink jet recording head equivalent to a first embodiment of the invention will be described below.

Figure 1A:
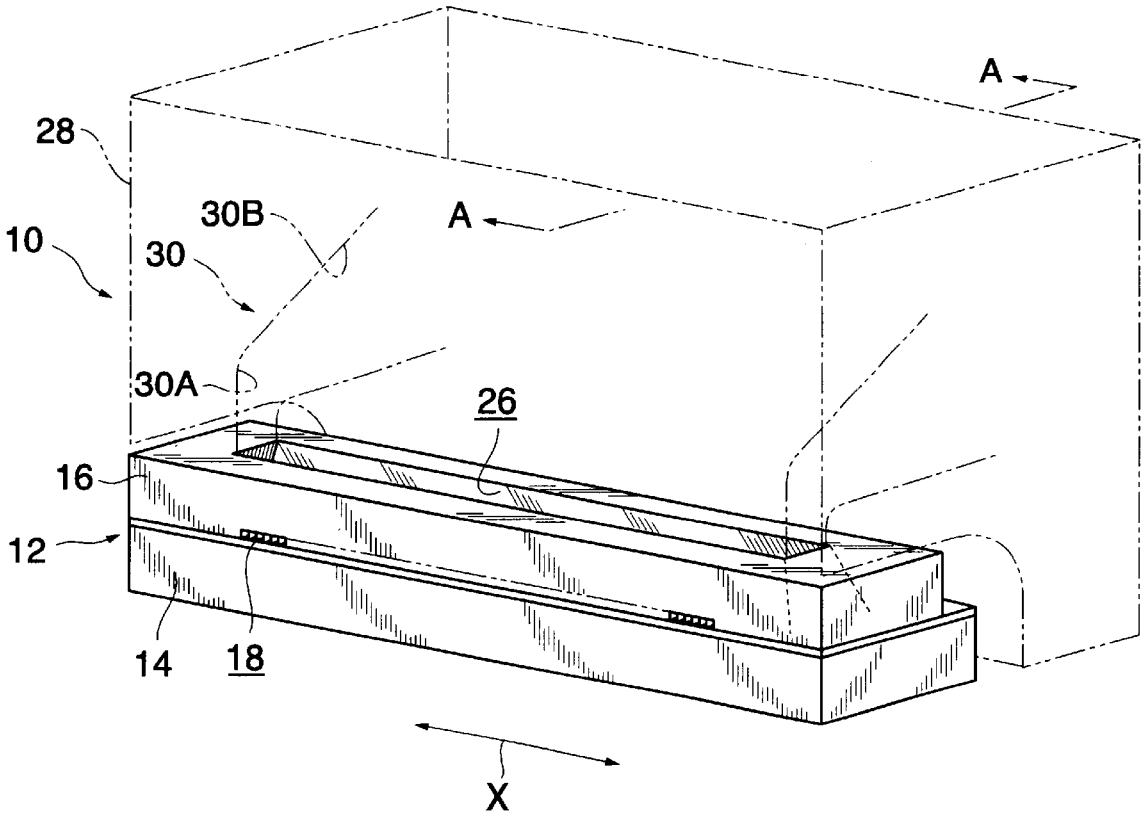
FIG. 1A is a perspective view showing a head chip and an ink supply member equivalent to a first embodiment of the invention and FIG. 1B is a perspective view showing the back side of the head chip.
Figure 1B:
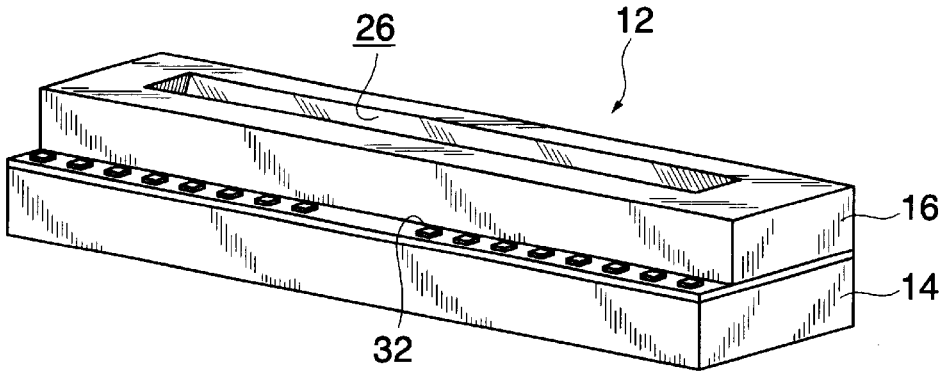
Figure 2:
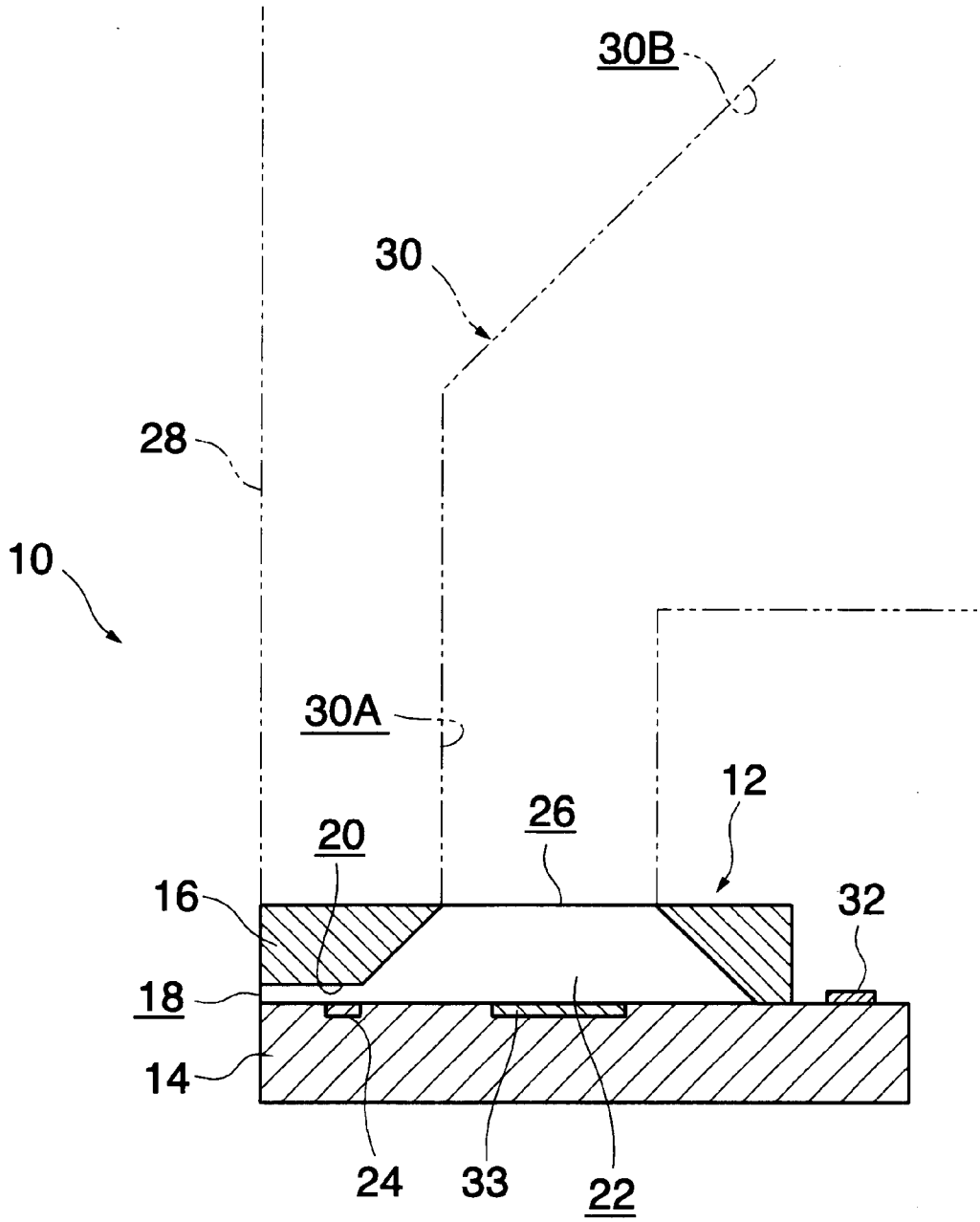
FIG. 2 is a sectional view viewed along the line A—A in FIG. 1A.

As shown in FIGS. 1A and 1B and FIG. 2, a head chip 12 making up the ink jet recording head 10 is formed by joining a heater element substrate 14 and a passage substrate 16 and is basically made up of plural nozzles 18 formed on one end face, an individual passage 20 communicating with each nozzle 18, a common liquid chamber 22 communicating with all individual passages 20 and extended in a nozzle arrangement direction and a heater element 24 arranged opposite to the individual passage 20.

Figure 3:
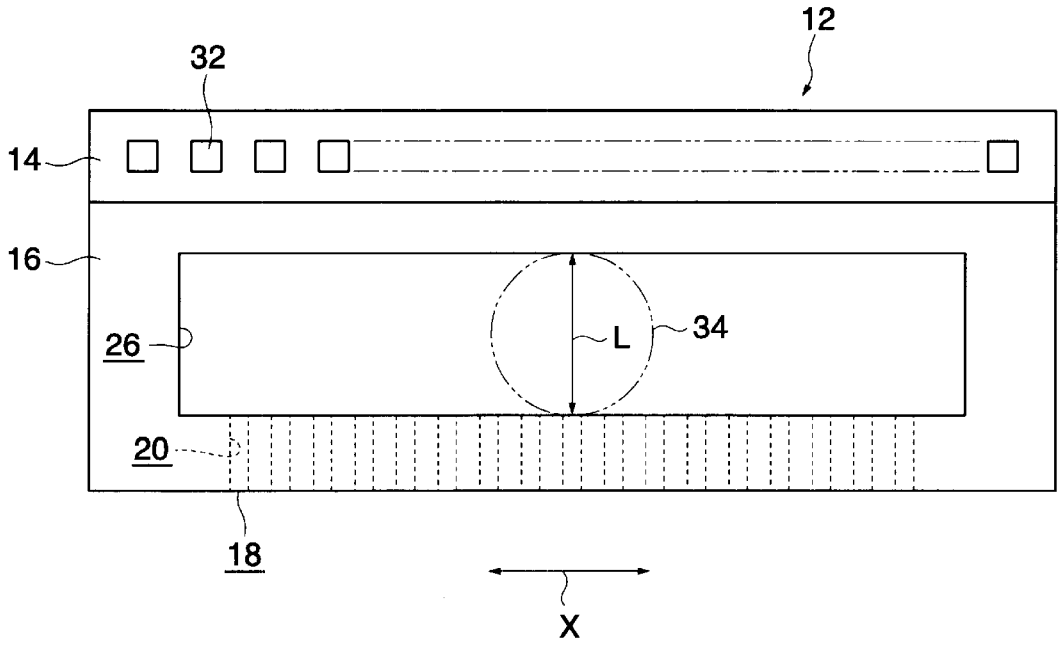
FIG. 3 is a plan showing the head chip equivalent to the first embodiment of the invention.

The common liquid chamber 22 communicates with each individual passage 20 and is connected to a supply passage 30 of an ink supply member 28 via a communicating port 26 shown in FIG. 3 formed in a direction perpendicular to the individual passage 20 (a direction shown by an arrow X). The communicating port 26 is in the shape of a rectangle extended in the longitudinal direction (the direction shown by the arrow X) of the passage substrate 16 and is formed so that the width is substantially equal to the width in which the nozzles 18 are provided in the longitudinal direction. In the meantime, the supply passage 30 is made up of a vertical part 30A extended upward and a widening part 30B formed of the bottom extended substantially horizontally and an inclined face tilted at approximately 45° upward. The vertical part 30A has the same sectional shape as that of the communicating port 26 or has a sectional shape slightly larger than the communicating port 26. Also, the widening part 30B is connected at one end to an ink tank (an ink chamber) not shown.

As shown in FIG. 1B, an electric signal input-output terminal 32 is provided on the back side of a nozzle 18 formation surface of the head chip 12. A driving circuit 33 for driving the heater element 24 is provided on the side of the common liquid chamber 22 of the heater element substrate 14.

The action of the ink jet recording head 10 made up as described above will be described below.

In the ink jet recording head 10, when ink is consumed by jetting ink droplets from the nozzle 18, ink is supplied from the ink tank not shown to the individual passage 20 via the supply passage 30 of the ink supply member 28, the communicating port 26 and the common liquid chamber 22. When the heater element 24 is heated, ink droplets are jetted from the nozzle 18.

If ink droplets are jetted as described above, bubbles are deposited in the common liquid chamber 22 by the heat of ink. As these bubbles grow over time and block the communicating port 26 when they stay in the common liquid chamber 22, the supply of ink from the ink supply member 28 to the common liquid chamber 22 is blocked, jetting from the nozzle 18 may be disabled and as a result, printing may be disabled (a so-called void may be caused).

However, in the invention (in this embodiment), as an ink supply path (the communicating port 26 and the supply passage 30) from the ink tank to the common liquid chamber 22 is designed so that bubbles generated and grown in the common liquid chamber 22 are carried to the ink tank which has no effect on printing by the buoyancy of bubbles themselves, printing failure (a void) can be securely prevented.

A condition on which bubbles can be exhausted from the head chip 12 (the common liquid chamber 22) will be examined below.

First, a condition under which bubbles rise because of their buoyancy against the flow of supplied ink is found. That is, a condition under which buoyancy exceeds resistance in a place where largest resistance acts upon bubbles in the ink supply path from the ink tank to the common liquid chamber 22 (the flow velocity is the most rapid) is found. In this embodiment, a part where the flow velocity is the most rapid in the ink supply path is the communicating port 26 the cross section of which is minimum. A condition under which bubbles are moved (rise) by buoyancy in the communicating port 26 is found.

Assuming that, in the ink supply path (the communicating port and the supply passage 30) from the common liquid chamber 22 to the ink tank, the minimum cross section (the opening area of the communicating port 26 in this embodiment) is S, the volume of an ink droplet jetted from the head is V, the highest printing frequency is f, the number of nozzles is n, the jetting rate is D, the density of ink is ρ, the gravitational constant is g, the resistance coefficient is Cd, the diameter of a bubble is d and the minimum width of the communicating port 26 is L, then the buoyancy F1 of a bubble d in diameter can be expressed as follows.

$$(\rho \times g \times \pi \times d^3)/6 \tag{9}$$

Also, the flow velocity of ink in the communicating port (the section having the cross section of S) to the ink chamber can be expressed as follows $$n \times V \times f \times D/S \tag{10}$$

and resistance F2 to bubbles at the flow velocity can be expressed as follows.

$$\{(n \times V \times f \times D/S)^2 \times Cd \times \rho \times \pi \times d^2\}/8 \tag{11}$$

Figure 4:
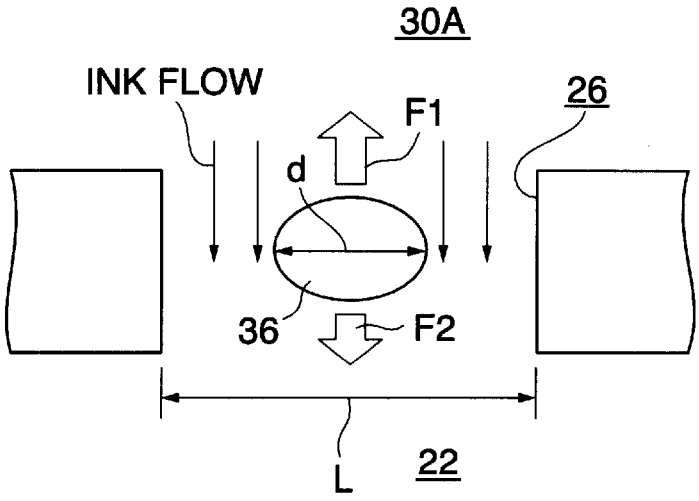
FIG. 4 is an explanatory drawing showing the relation of force that acts upon a bubble in a communicating port of the head chip equivalent to the first embodiment of the invention.

That is, assuming that an average jetting rate in printing a normal text image is 5% or more based upon the above relationship, it can be said that the buoyancy F1 exceeds resistance F2 in the case of a bubble 36 of the diameter d that satisfies the following relationship as shown in FIG. 4.

$$D \geqq 0.05 \tag{12}$$

$$\{(n \times V \times f \times D/S)^2 \times Cd \times \rho \times \pi \times d^2\}/8 < (\rho \times g \times \pi \times d^3)/6 \tag{13}$$

Therefore, if the diameter d of the bubble 36 at this time has the following relation to the minimum width L of the communicating port 26, the bubble 36 can be moved to the ink tank via the communicating port 26 of the head.

$$d < L \tag{14}$$

The minimum width L of the communicating port 26 means the diameter of the maximum inscribed circle 34 inscribed on the wall of the communicating port 26 at the cross section as shown in FIG. 3.

However, as the movement of bubbles is difficult if bubbles adhere to the wall in the communicating port 26, it is desirable that a fixed margin is secured. In the case of the communicating port 26, it is suitable that the minimum width L (the coefficient is 3) having the following relationship is secured to enable bubbles to be moved even if the bubbles adhere to the walls on both sides with the minimum width L between the walls.

$$d < L/3 \tag{15}$$

Needless to say, when the ink supply path is curved or there is a long path to go through, the coefficient is required to be further increased.

Hereby, the supply of ink to the individual passage 20 is prevented from being blocked by the generation and growth of bubbles in the common liquid chamber 22 and the generation of a void in a block which cannot be recovered of itself can be avoided.

In the above case, the jetting rate D is set to 5% or more, however, if a photographic image and Power Point (presentation software manufactured by Microsoft) data are assumed, an even higher printing rate is required and if these are continuously printed, the design that the above relationship is satisfied when the jetting rate D is 15% or more, preferably 30% or more is desirable.

Also, in addition to the shortage of the supply of ink because of a gigantic bubble (described above to be a void in a block which is unrecoverable of itself), there is a defect caused because a bubble having a diameter exceeding a fixed diameter is led to the individual passage 20 according to the flow of ink. This defect is normally caused in nozzles and is recovered of itself when the bubble is removed from the nozzle 18. However, if a void is caused by insufficient jetting from the adjacent two or more nozzles 18, an image formed by the jetting may not be allowable even if it recovers of itself quickly. To enhance the reliability of an image, these defects have to be prevented as well.

A phenomenon that ink cannot be jetted from adjacent plural nozzles 18 is caused when a bubble blocks adjacent two or more individual passages 20 in the common liquid chamber 22 and no ink is supplied to the individual passages 20.

To prevent a void by insufficient jetting from two or more nozzles 18, the head chip is required to be designed so that a bubble blocking two or more individual passages 20 is moved by buoyancy from the common liquid chamber 22 to the side of the ink tank.

Figure 5:
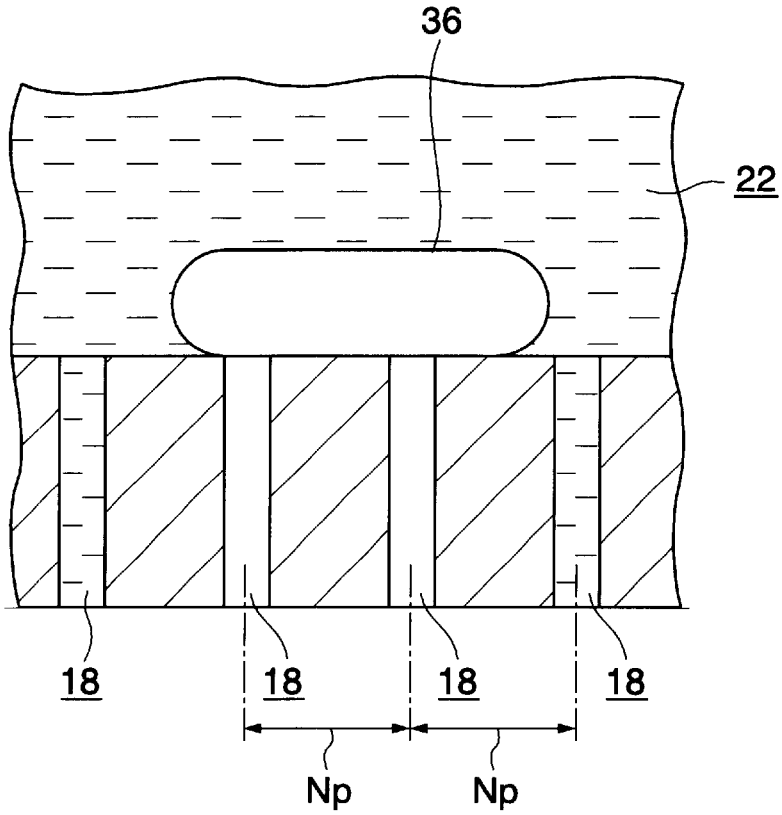
FIG. 5 is an explanatory drawing showing a state that a bubble blocks an individual passage in a common liquid chamber of the head chip equivalent to the first embodiment of the invention.

That is, a bubble 36 shown in FIG. 5 having a double or larger diameter of nozzle pitch Np needs to be moved from the common liquid chamber 22 to the side of the ink tank via the communicating port 26.

Therefore, if the jetting rate D is 5% or more, a bubble satisfying the following relationship (16) is required to necessarily satisfy the following relationship (17) and (18).

$$d \geqq 2Np \tag{16}$$

$$D \geqq 0.05 \tag{17}$$

$$\{(n \times V \times f \times D/S)^2 \times Cd \times \rho \times \pi \times d^2\}/8 < (\rho \times g \times \pi \times d^3)/6 \tag{18}$$

Hereby, a bubble blocking adjacent two or more individual passages 20 can be necessarily moved by buoyancy.

Also in this case, the jetting rate D is desirably 15% or more and preferably, 30% or more. In this case, a printing defect to be prevented is assumed to be a void by insufficient jetting from continuous two or more nozzles 18, however, since a void by insufficient jetting from one nozzle in a device for which high reliability is required for outputting a drawing is not allowed, an expression d>Np is required in the above expression (16).

The above action will be described below in comparison with the conventional example 1. For calculated values in the conventional example 1, the viscosity of ink $\mu$ is $20\times10^{-3}$ Pa·sec, the density of ink ρ is 1050 Kg/m$^3$, a printing frequency f is 12.8 kHz, the minimum cross section of the communicating port S is 0.5 mm$^2$, the number of nozzles is 512, the flow velocity of ink v is "n×V×f×D/S" and the resistance coefficient Cd is "$24\times\mu/(\rho\times v\times d)$", and if a printing rate is D and the volume of a jetted ink droplet is V, the diameter of a minimum bubble d that rises against flow velocity (resistance) in the communicating port is as shown in Table 1.

TABLE 1

| Jetting Rate D | d (V = 20 pl) | d (V = 10 pl) | d (V = 5 pl) |
|---|---|---|---|
| 0.4% | 60.7 μm | 42.9 μm | 30.4 μm |
| 1% | 95.8 μm | 67.7 μm | 47.9 μm |
| 2% | 135.4 μm | 95.8 μm | 67.7 μm |
| 5% | 214.2 μm | 151.4 μm | 107.1 μm |
| 15% | 302.9 μm | 214.2 μm | 151.4 μm |
| 30% | 524.6 μm | 370.9 μm | 262.3 μm |
| 50% | 677.2 μm | 478.9 μm | 338.6 μm |
| 100% | 957.8 μm | 677.2 μm | 478.9 μm |

Suppose the nozzles 18 are arranged at the pitch of approximately 800 dpi in the head, nozzle pitch Np is 31.75 μm and the diameter d of a bubble to rise to prevent a void by insufficient jetting from the nozzle is 63.50 μm or more according to the above expression (16). However, if the volume V of a ink droplet jetted from the head is 20 pl, a printing rate D at which a bubble in size equivalent to approximately pitch between two nozzles can rise against the flow velocity of ink in the communicating port is below 1%. If the volume V of an ink droplet jetted from the head is 5.0 pl, a printing rate (a jetting rate D) at which a bubble can similarly rise is approximately 2%. In any case, when a text image is printed (a jetting rate 5%), the above void cannot be avoided. For example, to achieve jetting of the printing rate (the jetting rate D) of 5% with V of 20 pl, when D=0.05 and d=63.5 μm are substituted in the expression (18), the minimum cross section S of the communicating port is calculated and ratio with that in the conventional example ($S=0.5\ mm^2$) is found, it is known that at least the minimum cross section of the communicating port needs to be approximately 12 times or more as large as the current one.

Also, when the minimum dimension L (coefficient: 3) that can securely prevent a naturally unrecoverable defect caused in the large region of the communicating port is found based upon the diameter of a rising bubble if the head is driven with an ink droplet having the volume of 20 pl and at the printing rate (the jetting rate D) of 5%, $L=d\times3=214.2\times3=642.6$ μm. This is larger than approximately 500 μm of the diameter of the communicating port in the conventional example 1 and others and in the conventional example 1, a naturally recoverable printing defect may be caused by a rising bubble.

In the meantime, in the ink jet recording head 10, as the communicating port 26 of the head chip 12 is in the shape of a rectangle extended in the longitudinal direction of the passage substrate 16, the cross section can be set to approximately 6 $mm^2$. As a result, the diameter of a bubble that can rise can be reduced by reducing the flow velocity in supplying ink. Table 2 shows the result of calculating the diameter of a bubble that can rise.

TABLE 2

| Jetting Rate D | d (V = 20 pl) | d (V = 10 pl) | d (V = 5 pl) |
|---|---|---|---|
| 1% | 27.7 μm | 19.6 μm | 13.9 μm |
| 2% | 39.2 μm | 27.7 μm | 19.6 μm |
| 5% | 62.2 μm | 43.8 μm | 31.0 μm |
| 15% | 87.6 μm | 62.0 μm | 43.8 μm |
| 30% | 151.8 μm | 107.3 μm | 75.9 μm |
| 50% | 196.0 μm | 138.6 μm | 98.0 μm |
| 100% | 277.1 μm | 196.0 μm | 138.6 μm |

As shown above, in the ink jet recording head 10, if the volume V of a jetted ink droplet is 20 pl if the nozzles are formed at the pitch of 800 dpi, continuous printing is enabled without a void by jetting from plural nozzles at the printing rate (the jetting rate D) of 5% or less by increasing the cross section of the communicating port 26 and even if continuous printing is performed up to the printing rate (the jetting rate D) of approximately 15% if V is 10 pl, the head free of the defect of a bubble is acquired.

As clear from this calculation, a head having more nozzles and a higher printing frequency and a larger volume of an ink droplet jetted, that is, a head in which more ink is supplied per unit time, is required to increase the area of the opening of the ink communicating port and reduce the flow velocity.

In this embodiment, the dimension of the communicating port 26 is made larger than that in the conventional example 1, the shape of the ink supply path (the supply passage 30) from the common liquid chamber 22 to the ink tank is simplified and curvature is reduced. Therefore, a bubble that causes a complete void and a void by insufficient jetting from plural nozzles can be moved from the communicating port 26 to the side of the ink tank via the supply passage 30 by buoyancy. Therefore, both a complete void and a void by insufficient jetting from plural nozzles can be securely prevented.

In order to remove bubbles from the common liquid chamber 22 by buoyancy, it is necessary that the communicating port 26 formed in the common liquid chamber 22 is open upward in a gravitational direction, however, the communicating port 26 does not necessarily have to be directed upward in a gravitational direction during printing and the ink jet recording head may also be made up so that the posture varies during an interval and during a halt and is directed upward in a gravitational direction. In this case, as no ink is supplied, resistance F2 expressed in the expression (11) does not act, however, as a bubble largely grows during printing, it cannot pass the communicating port 26 unless the communicating port is largely open. Therefore, the communicating port needs to have the minimum cross section that substantially satisfies the relational expressions in the invention.

Also, in the ink jet recording head 10, as the driving circuit 33 is provided to the side of the common liquid chamber 22, it is effectively cooled by ink. As a result, the rise of the temperature of the head chip 12 during printing is inhibited and continuous printing is stably enabled.

(Second Embodiment)

Next, an ink jet recording head equivalent to a second embodiment of the invention will be described below. The same reference numbers are allocated to the same components for those in the first embodiment and a detailed description is omitted.

In this embodiment, to exhaust a bubble from a common liquid chamber 22 to the side of an ink tank, the cross section of a communicating port is maximized to enhance the exhaust of a bubble.

Figure 6A:
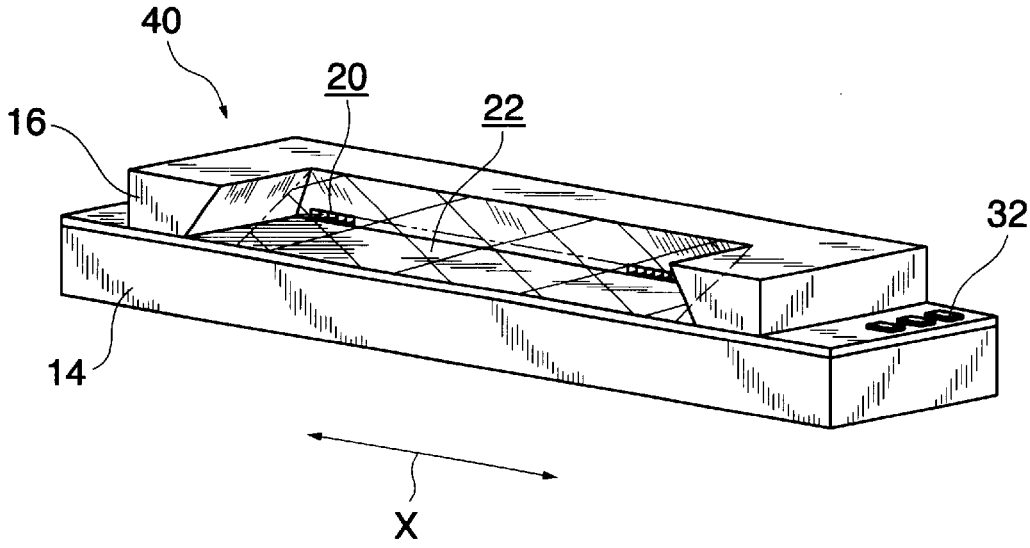
FIG. 6A is a perspective view showing the front side of a head chip equivalent to a second embodiment of the invention and FIG. 6B is a perspective view showing the back side of the head chip.
Figure 6B:
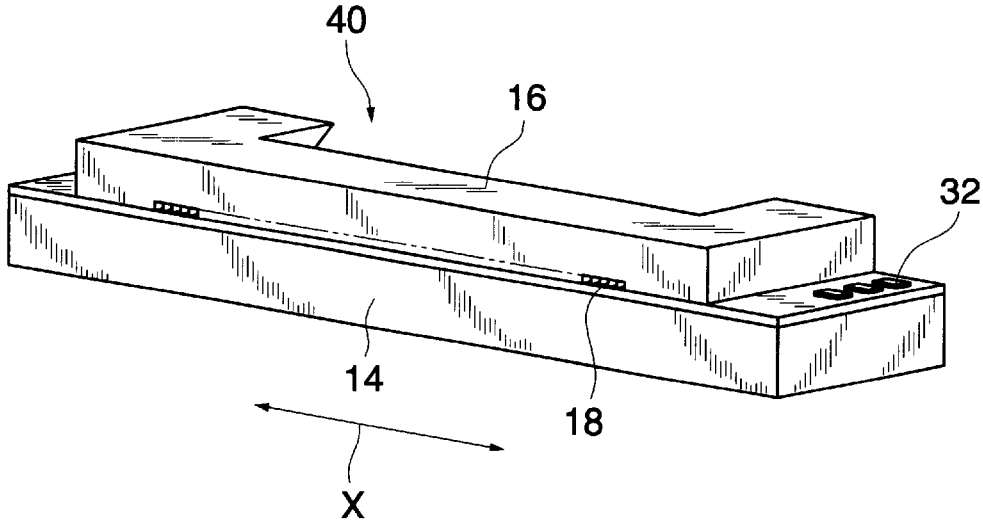

As shown in FIGS. 6A and 6B, the common liquid chamber 22 provided to a head chip 40 is not only open to the upside of a passage substrate 16 but open to the back (an end face on reverse side to a nozzle 18). As described above, to make up the head chip 40, an electric signal input-output terminal 32 is formed at both ends in the longitudinal direction offset from a position in which the nozzle 18 (an individual passage 20) is formed in the longitudinal direction (a direction shown by an arrow X) of a heater element substrate 14.

In the head chip 40 formed as described above, as shown in FIG. 7, the common liquid chamber 22 communicates with an ink subchamber 45 by fixing the heater element substrate 14 on a heat sink 41 and fastening the heater element substrate to the end of an ink subtank 44 via an elastic member 42. The ink subchamber 45 is connected to an ink tank not shown via a filter 47.

The ink subtank 44 is similar to the ink supply member 28 in the first embodiment in that the ink subtank fulfills a function to supply ink from the ink tank to the common liquid chamber 22, however, the ink subtank fulfills the similar function to the ink tank (is different from the ink supply member 28) in that since the ink subchamber 45 enhances the supply of ink and the exhaust of ink with simple structure (substantially rectangular structure) and has sufficient capacity (cross section), the ink subchamber can securely supply ink to the common liquid chamber 22 even if bubbles exist inside the ink subchamber.

A resin layer 48 is formed on the surface of the heater element substrate 14 to protect a circuit and others from ink.

Figure 8:
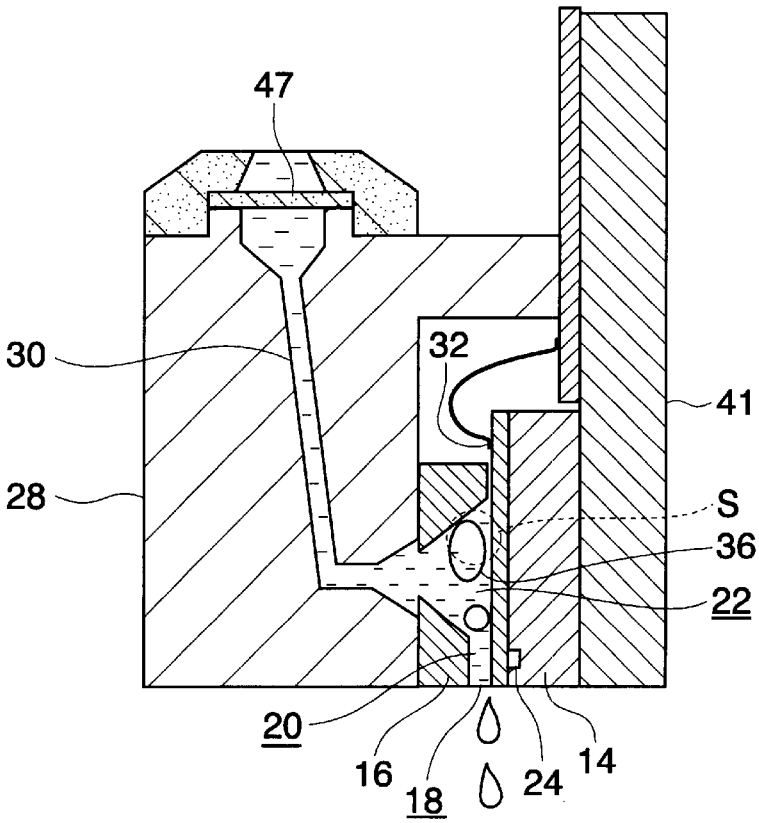
FIG. 8 is a longitudinal section showing an ink jet recording head in a comparison example.

The action of an ink jet recording head 46 formed as described above will be described below, comparing with a comparison example shown in FIG. 8. For the comparison example, the same reference numbers are allocated to the same components for those in the ink jet recording head 46 and a detailed description is omitted.

In the ink jet recording head 46, there is no boundary between the ink subchamber 45 and the common liquid chamber 22 and they are integrated. That is, the ink jet recording head 46 eliminates the curvature of an ink supply path, can make the ink supply path as simple as possible and also eliminates a dead water region S which is a problem in the comparison example respectively by arranging the electric signal input-output terminal 32 shown in FIG. 8 at both ends in the longitudinal direction.

In the ink jet recording head 46, the ink subtank 44 and the common liquid chamber 22 are integrated, however, the area of the opening of the communicating port is intentionally found. That is, when the area of the communicating port is found in the similar specification to that in the conventional example 1 assuming that a diagonal part in FIG. 6A is equivalent to the communicating port, it is 31.5 $mm^2$. This value is approximately 60 times or more as compared with for 0.5 $mm^2$ in the conventional example 1. Therefore, in calculation using the expressions (16) to (18), in the ink jet recording head 46, continuous printing at a high printing rate of approximately 25% is possible even if the volume V of a jetted ink droplet is 20 pl.

Further, as the common liquid chamber 22 is formed up to the side of the back of the head chip 40, the ink contact area of the heater element substrate 14 is increased, compared with that in the first embodiment. Therefore, the generation density of bubbles generated when ink is in contact with the heater element substrate 14 and the temperature of ink rises is reduced as the ink contact area is increased if the head chips are of the same size and the quantity of generated bubbles is similar. That is, in this embodiment, the generation density of bubbles for the heater element substrate 14 is reduced, compared with that in the first embodiment, the generation of bubbles in a position far from the individual passage 20 relatively increases and the generation of a printing defect can be further inhibited.

Also, because the area that is in contact with ink of the surface of the heater element substrate 14 (the resin layer 46) is increased and the common liquid chamber 22 is integrated with the ink subchamber 45 by making up the head chip 40 as described above, and thereby the substantial capacity of ink that contributes to outgoing radiation particularly increases, there is effect that the rise of the temperature of the head during printing is inhibited and the ink jet recording head 46 wherein continuous printing at a high printing rate is enabled can be provided.

Figure 9:
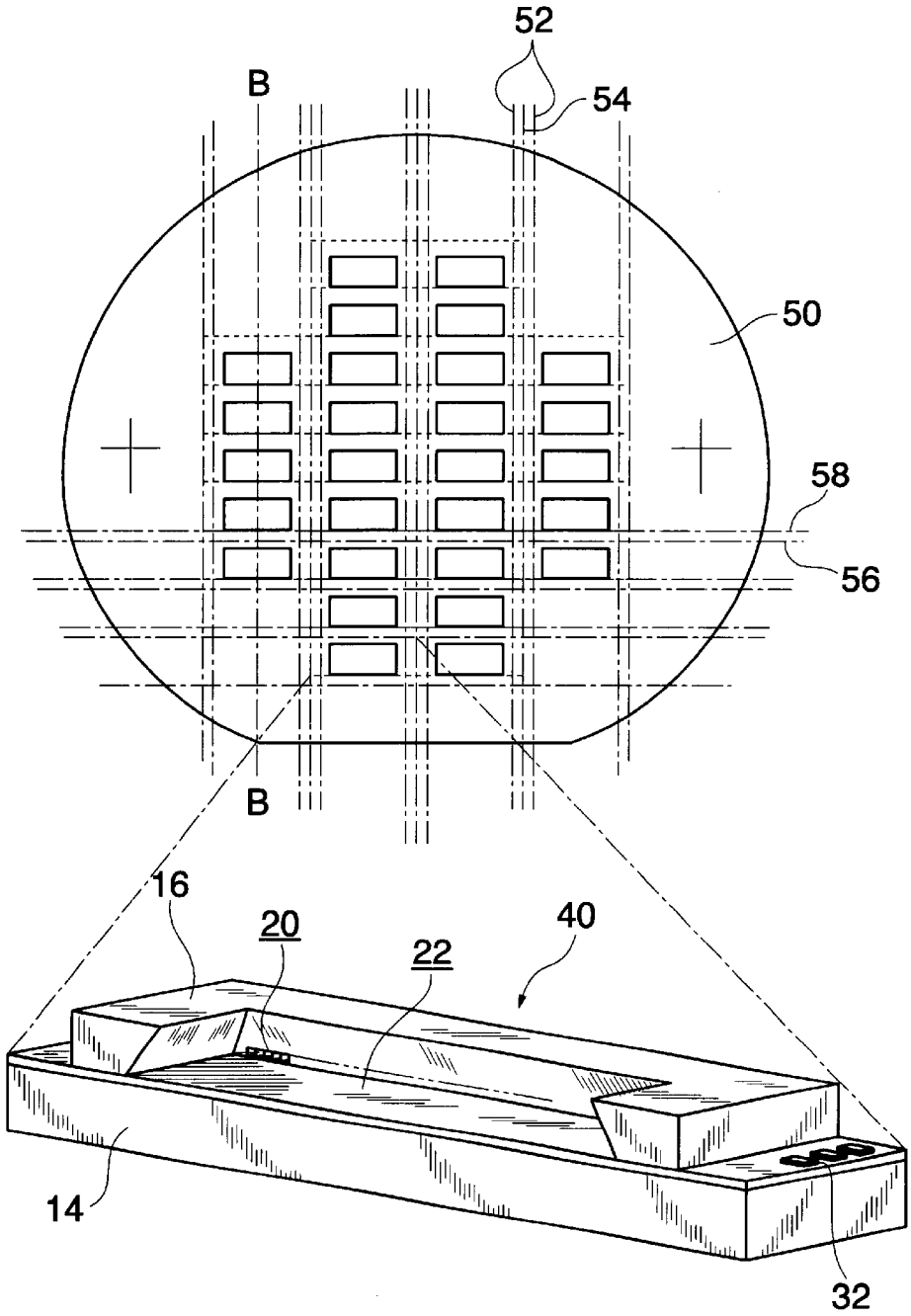
FIG. 9 is an explanatory drawing showing a method of producing the head chip equivalent to the second embodiment of the invention.
Figure 10:
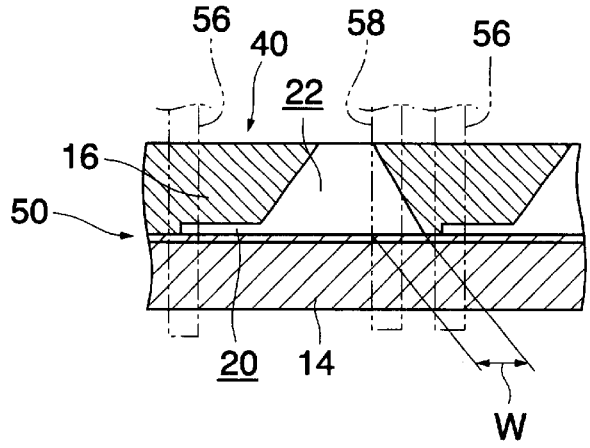
FIG. 10 is an explanatory drawing showing the method of producing the head chip equivalent to the second embodiment of the invention.

Referring to FIGS. 9 and 10, a process for producing multiple head chips 40 equivalent to this embodiment from silicon wafers will be described below. Two silicon wafers are diced and isolated, in the former of which multiple heater element substrates 14 are arranged and in the latter multiple passage substrates 16 each of which includes the common liquid chamber 22 and the individual passage 20 are arranged are joined.

First, the electric signal input-output terminal 32 is exposed on the head chip by cutting the jointed silicon wafers 50 on the side of the passage substrate 16 along a wire bonding area opening dicing line 52.

Next, the joined silicon wafers 50 can be isolated into each head chip 40 by cutting them along head cutting isolation dicing lines 54, 56 and 58.

The head chip 40 can be efficiently produced by simultaneously producing plural head chips 40 from the silicon wafers 50 as described above.

(Third Embodiment)

Next, referring to FIGS. 11 to 15, an ink jet recording head equivalent to a third embodiment of the invention will be described. The same reference numbers are allocated to the same components for those in the first and second embodiments and a detailed description is omitted.

Figure 11A:
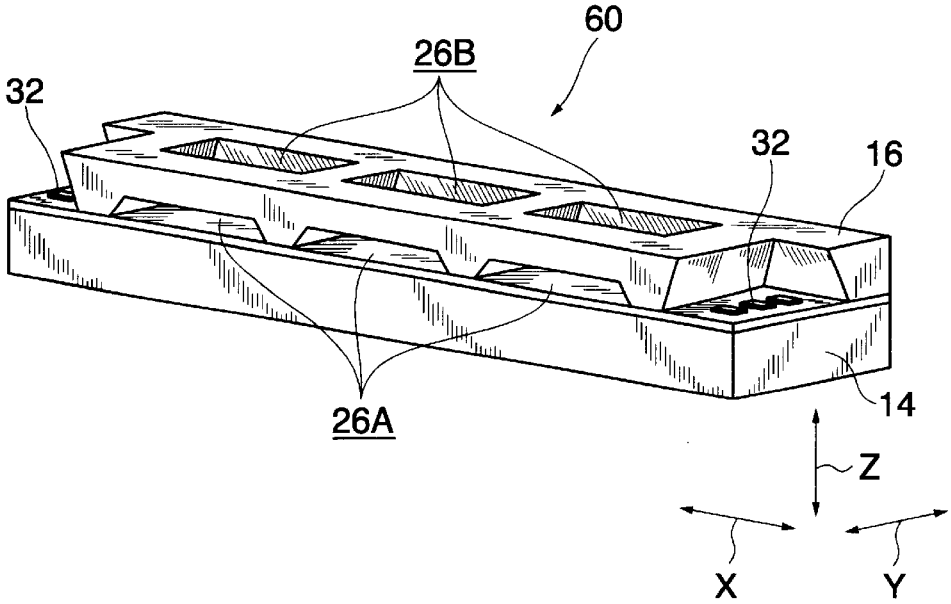
FIG. 11A is a perspective view showing the front side of a head chip equivalent to a third embodiment of the invention and FIG. 11B is a perspective view showing the back side of the head chip.
Figure 11B:
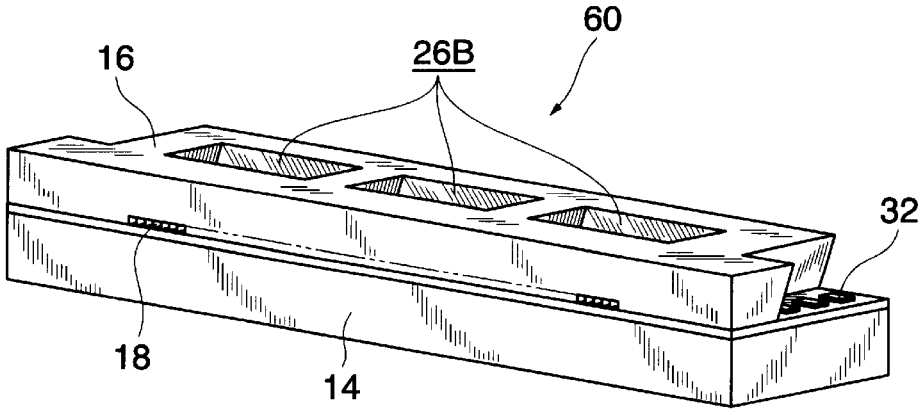

As shown in FIGS. 11A and 11B, in a head chip 60, a communicating port 26A open in a direction in which an individual passage 20 is extended (a direction shown by an arrow Y) and a communicating port 26B open in a direction perpendicular to the extended direction (a direction shown by an arrow Z) are formed, three of them each, in a nozzle arrangement direction.

A method of producing the head chip 60 made up as described above will be described below. A basic production method is similar to that in the second embodiment, however, excellent points in the method of producing the head chip 60 will be described in view of the configuration of the head chip below, comparing with the second embodiment.

In the second embodiment, in production of the head chip 40, the wall of the communicating port has the inclination of 54.7° if the communicating port is made by ODE from the side on which the substrates are joined (a crystal face of 100 Si) as shown in FIG. 10. Therefore, if the thickness of the substrate is 550 $\mu$m, the width W of a diagonal part is approximately 390 $\mu$m. Therefore, a groove of the next head chip cannot be formed in a diagonal part on a silicon wafer and a fixed distance is required between head chips. As a result, as shown in FIGS. 9 and 10, in the process for dicing and isolating the head chip in a shorter direction, dicing (dicing along the head dicing isolation dicing lines 56 and 58) is required twice or dicing large in cut width (using a thick dicing sword) is required, the yield of head chips from a wafer of the same size decreases and the unit price of the head chip is increased.

Also, the problem is solved by opposing the sides of the individual passages of head chips and the sides of the rear openings, however, the area of the through-hole in a silicon wafer is increased and the strength of the passage substrate is insufficient. Also, dicing width precision is included in the dicing position precision of the nozzle face and it is difficult to correspond to a high density and high definition head in the future requiring high precision.

Figure 7:
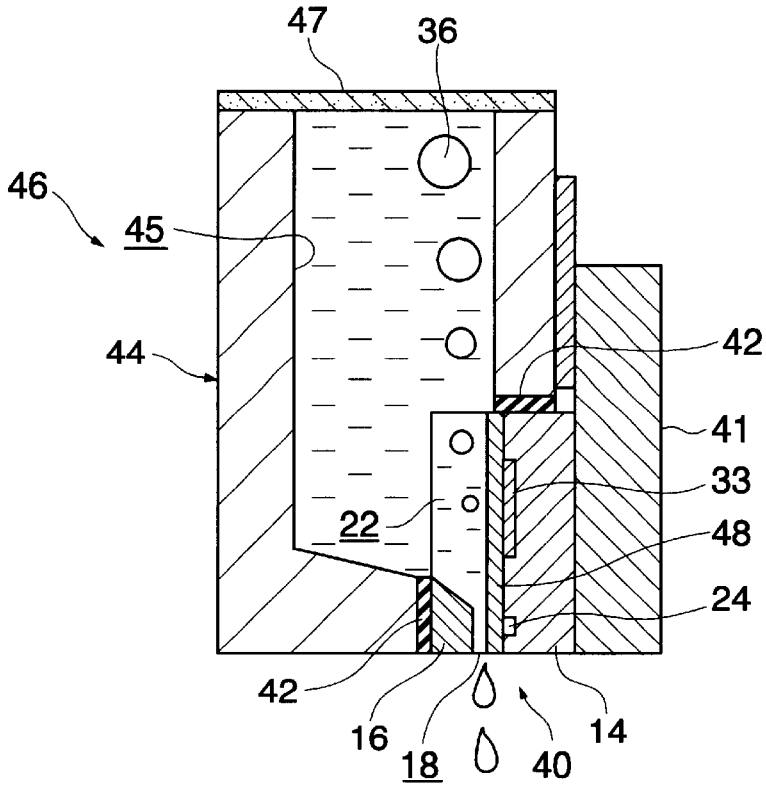
FIG. 7 is a longitudinal section showing an ink jet recording head in the second embodiment of the invention.

Further, as shown in FIGS. 6A and 6B and FIG. 7, the area in which the passage substrate 16 and the heater element substrate 14 are joined is small and insufficient strength in joining of the head chip 40 is feared.

Figure 12:
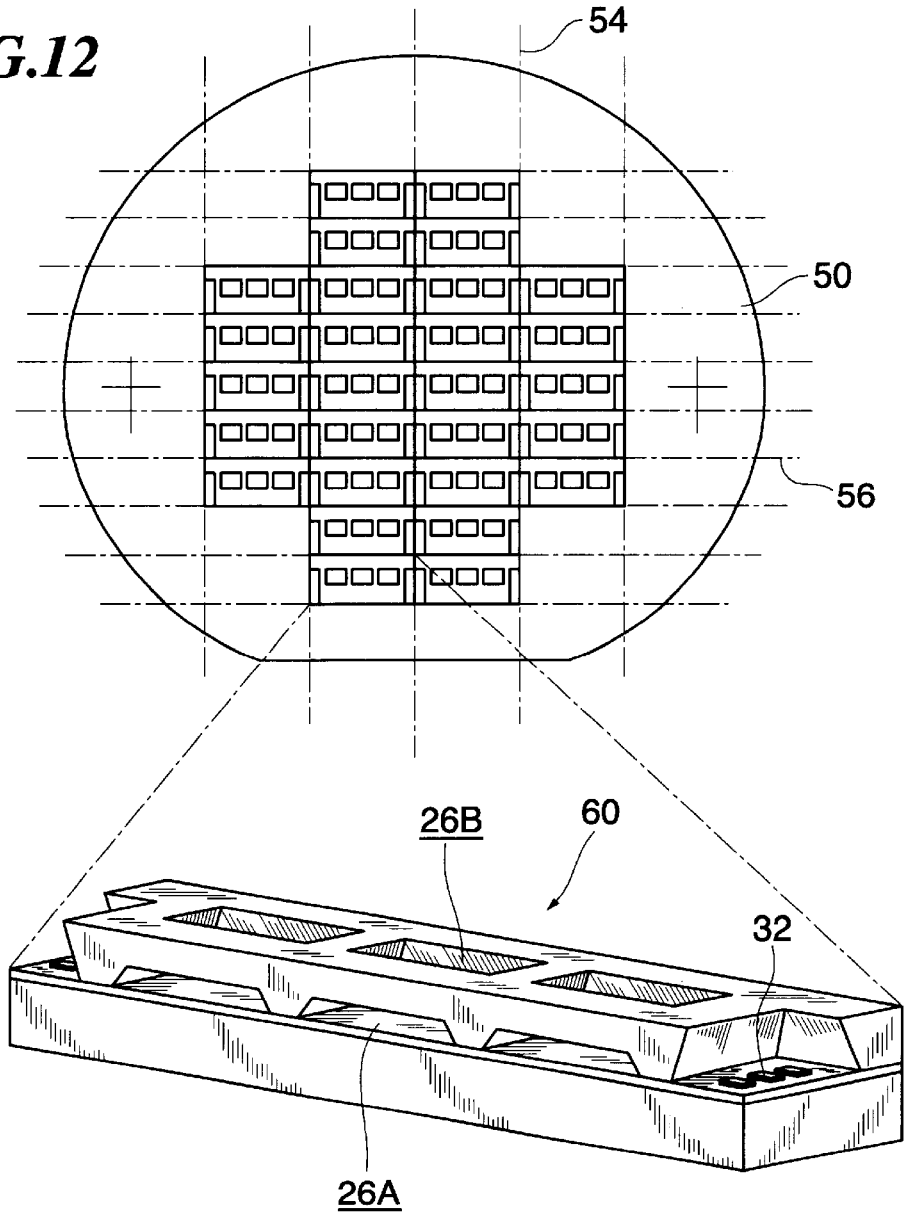
FIG. 12 is an explanatory drawing showing a method of producing the head chip equivalent to the third embodiment of the invention.
Figure 13:
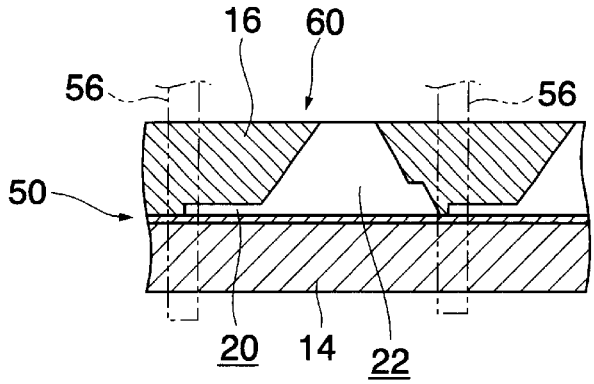
FIG. 13 is an explanatory drawing showing the method of producing the head chip equivalent to the third embodiment of the invention.

In the meantime, in the head chip 60 equivalent to this embodiment, the communicating ports 26A and 26B are respectively divided into plural parts to increase the total area of the communicating port as shown in FIGS. 12 and 13, and the strength on the side of the passage substrate 16 can be secured.

In addition, the communicating port 26A of the head chip 60 is opened by dicing along the head dicing isolation dicing line 56 in the dicing and isolation process and the end of the nozzle of the adjacent head chip 60 can also be opened. That is, the shorter side of the head chip 60 can be cut by dicing of one time, and the reduction of the dicing and isolation process and the enhancement of the yield of head chips from a wafer can be implemented. As a result, the unit price of the head chip can be further reduced. Also, since the area in which ink is in contact with the surface of the heater element substrate 14 can also be secured as in the second embodiment and in addition, since ink is supplied along the heater element substrate 14 from the communicating port 26A, the degree of outgoing radiation by ink is equal to that in the second embodiment.

Figure 14A:
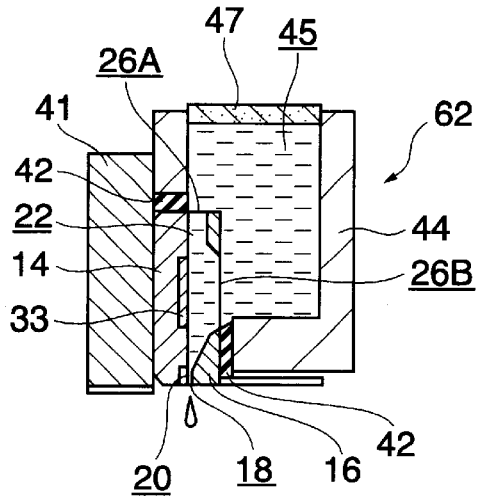
FIG. 14A is a longitudinal section showing an ink jet recording head in the third embodiment of the invention.
Figure 14B:
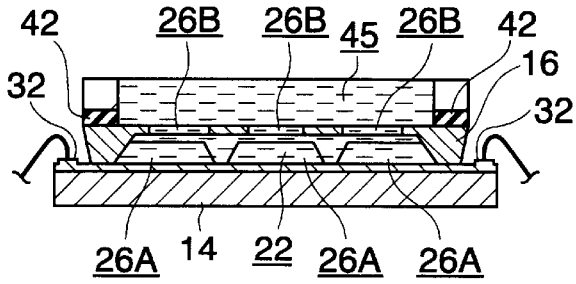
FIG. 14B is a sectional view showing the vicinity of the head chip of the ink jet recording head.
Figure 14C:
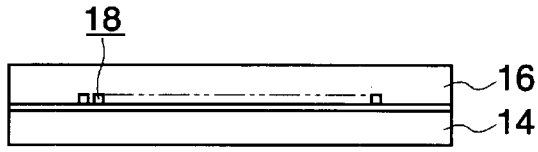
FIG. 14C is a front view showing the head chip.
Figure 14D:
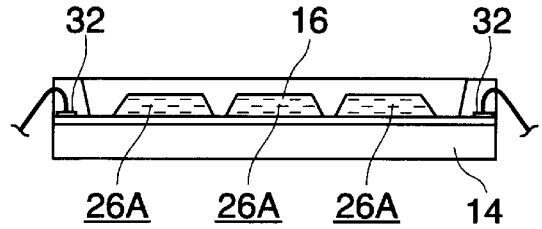
FIG. 14D is a back view showing the head chip and FIG. 14E is a plan showing the head chip.
Figure 14E:
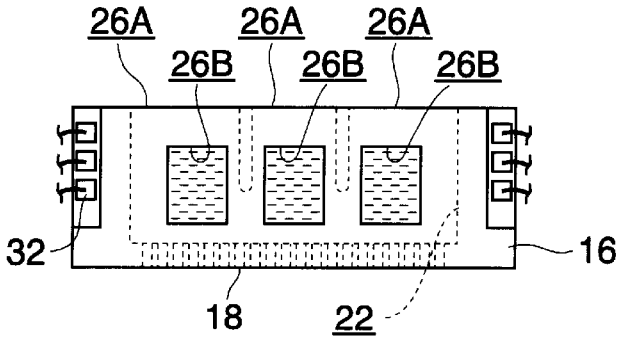
Figure 15A:
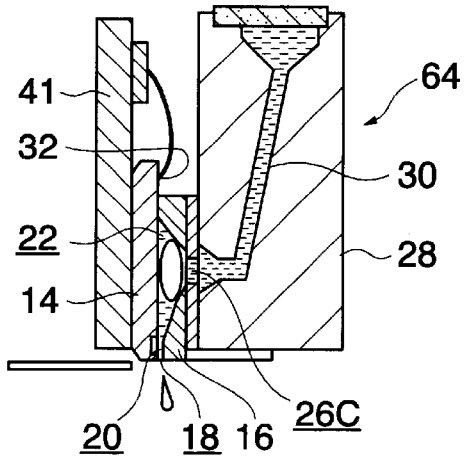
FIG. 15A is a longitudinal section showing an ink jet recording head in a comparison example.
Figure 15B:
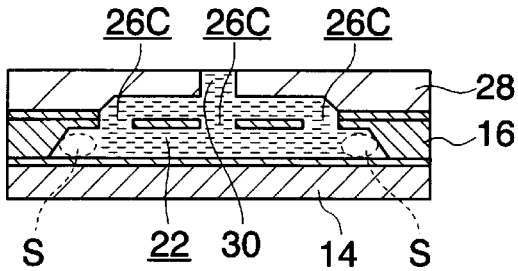
FIG. 15B is a sectional view showing the vicinity of a head chip of the ink jet recording head.
Figure 15C:
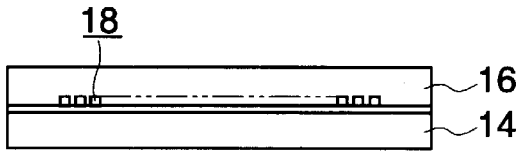
FIG. 15C is a front view showing the head chip.
Figure 15D:
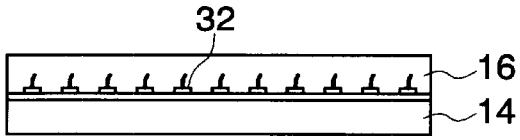
FIG. 15D is a back view showing the head chip and FIG. 15E is a plan showing the head chip.
Figure 15E:
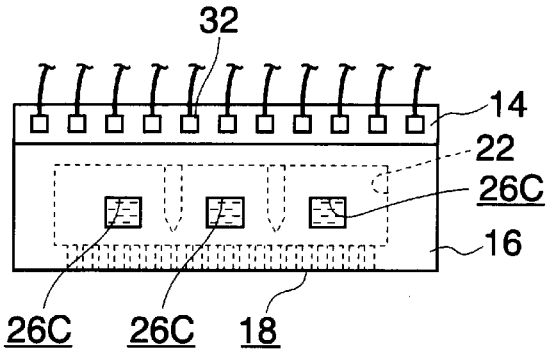

The head chip 60 formed as described above includes an ink jet recording head 62 by pressing the head chip upon the end of an ink subtank 44 via an elastic member 42 as shown in FIG. 14A. In the ink jet recording head 62, a common liquid chamber 22 communicates with an ink subchamber 45 of an ink subtank 44 via the communicating ports 26A and 26B.

The action of the ink jet recording head 62 made up as described above will be described below in comparison with the comparison example (see FIGS. 15A to 15E). In the comparison example, three communicating ports 26C are formed only in one direction (a direction shown by an arrow Z) and the communicating port 26C communicates with a supply passage 30 of a supply member 28 between the communicating port and an ink tank.

As shown in FIGS. 15A to 15E, in a head chip 64 in the comparison example, since the communicating port 26C is open only in one direction, a dead water region S is generated at both end in the longitudinal direction of the common liquid chamber 22 even if three communicating ports are provided, and bubbles may stay inside the common liquid chamber 22.

In the meantime, in the head chip 60 equivalent to this embodiment, as shown in FIG. 14A, if the ink jet recording head 62 is arranged, a bubble tries to move to the communicating port 26A provided upward in a gravitational direction by buoyancy and further, as ink warmed in the common liquid chamber is also guided by heat convection, the ink helps the bubble to be exhausted from the communicating port 26A (the common liquid chamber 22) to the supply passage 30. In the meantime, ink is supplied from the communicating port 26B the passage resistance of which is small (the opening of which is large).

Also, since communicating ports 26A and 26B, three of them each, are provided in two directions perpendicular to the common liquid chamber 22 in the head chip 60 equivalent to this embodiment, no dead water region S is caused in the vicinity of both ends in the longitudinal direction of the common liquid chamber 22.

As described above, a dead water region S is eliminated in the head chip 60 by providing the communicating ports 26A and 26B in different two perpendicular directions.

Further, since a bubble can be satisfactorily expelled if either of the communicating ports 26A or 26B is arranged in a range of 45° from the upside in a gravitational direction by providing the communicating ports 26A and 26B in two perpendicular directions, the constraints in arrangement of the ink jet recording head 62 are reduced (a bubble can be satisfactorily expelled by providing the communicating port in a direction in which the buoyancy of the bubble acts).

As described above, one communicating port 26A can be used for a bubble exhaust port and the other communicating port 26B can be used for an ink supply port respectively by making the communicating port 26A upward in a gravitational direction smaller than the communicating port 26B provided in a direction perpendicular to the communicating port 26A.

Needless to say, also in this case, the dimension of the communicating port for a bubble to pass enough is required. By making up as described above, a predetermined function can be achieved even if the total area is small, compared with the communicating port of the head chip 40 equivalent to the second embodiment.

A condition on which a rising bubble in the common liquid chamber 22 is moved into an ink chamber via any communicating port (a complete void is prevented) is shown below.

If k communicating ports are provided between the common liquid chamber 22 and the ink tank, the respective minimum cross sections of k pieces of communicating ports are $S_1$ to $S_k$, the volume of an ink droplet jetted from the head is V, a maximum printing frequency is f, the number of nozzles is n, the jetting rate is D, the density of ink is ρ, the gravitational constant is g, the resistance coefficient is Cd, the respective minimum width of k communicating ports are $L_1$ to $L_k$ and the diameter of a bubble is d, it is required that there is at least one communicating port that satisfies relationship expressed in the following expression (21) in the case of the following expressions (19) and (20).

$$D \geqq 0.05 \tag{19}$$

$$\{((n \times V \times f \times D/S_i) \times (L_i^4/\Sigma L_i^4))^2 \times Cd \times \rho \times \pi \times d^2\}/8 < (\rho \times g \times \pi \times d^3)/6 \tag{20}$$

$$d < L_1 \tag{21}$$

$\Sigma L_i^4$ means adding the fourth power of the minimum width Li of each communicating port from L1 to Lk ($L_1^4 + L_2^4 + \ldots + L_k^4$).

$(n \times V \times f \times D/S_i) \times (L_i^4/\Sigma L_i^4)$ denotes the maximum flow velocity of an 'i'th communicating port. Therefore, the expression (20) shows a condition under which a bubble can be moved in each communicating port. Therefore, the expression shows that the minimum width L is set so that a bubble which can be moved by buoyancy in each communicating port can pass the communicating port.

Needless to say, it is desirable that a margin is added to the minimum width L as in the first embodiment and "$d < L_i/3$" is satisfied. Also, if the communicating port 26A open upward in a gravitational direction satisfies the above relationship and the cross section is made smaller than the cross section of the communicating port 26B provided in a direction perpendicular to the upward direction, it is preferable to accelerate the exhaust of a bubble.

Also, as a condition for preventing the void due to insufficient jetting from plural nozzles, it is required that no bubble having a diameter double or more of nozzle pitch Np ($d \geqq 2Np$) exists in the common liquid chamber 22. Therefore, based upon the relationship described above, assuming that the jetting rate D is 5% or more, it is required that there is at least one communicating port having the minimum cross section $S_i$ that satisfies the relationship expressed in the following expressions (23) and (24) for a bubble satisfying the relationship expressed in the following expression (22).

$$d \geqq 2Np \quad (22)$$

$$D \geqq 0.05 \quad (23)$$

$$\{((n \times V \times f \times D/S_i) \times (L_i^4/\Sigma L_i^4))^2 \times Cd \times \rho \times \pi \times d^2\}/8 < (\rho \times g \times \pi \times d^3)/6 \quad (24)$$

In this case, it is also preferable that, in order to accelerate the exhaust of bubbles, the communicating port 26A open upward in a gravitational direction satisfies the relationship and the cross section of the communicating port 26A is made smaller than the cross section of the communicating port 26B provided in a direction perpendicular to the upward direction.

Further, although the case where the printing rate (the jetting rate D) is 5% or more is described above, 15% or more is desirable and 30% or more is preferable.

In this embodiment, three communicating ports are provided on the upper surface of the chip and at the back, however, the invention is not limited to this, and just one may be provided or plural communicating ports may be provided.

(Fourth Embodiment)

Figure 16A:
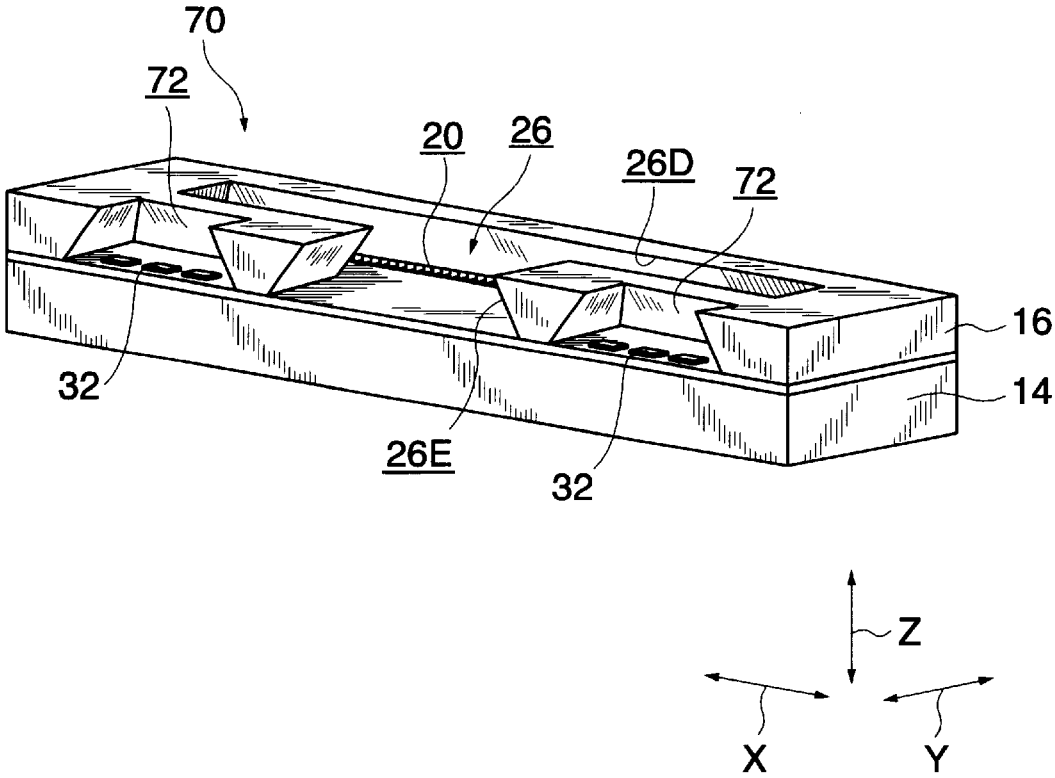
FIG. 16A is a perspective view showing the front side of a head chip equivalent to a fourth embodiment of the invention and FIG. 16B is a perspective view showing the back side of the head chip.
Figure 16B:
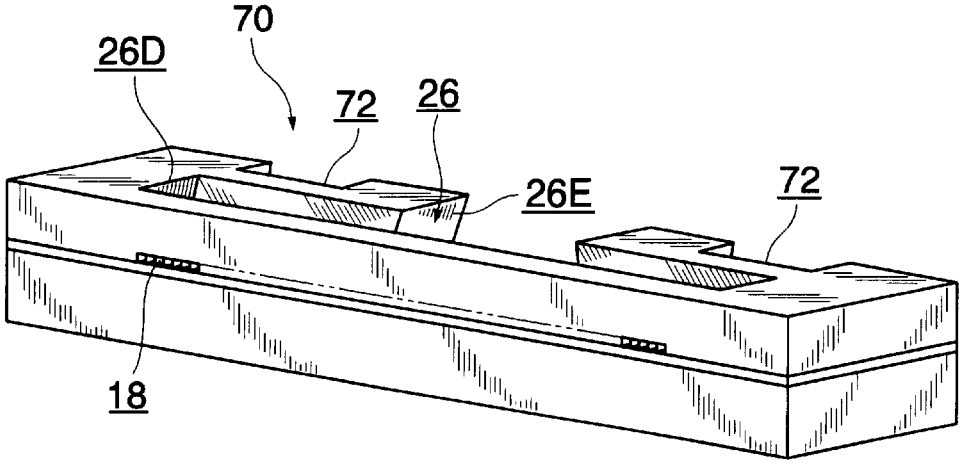

Referring to FIGS. 16A and 16B, a head chip equivalent to a fourth embodiment of the invention will be described below.

A head chip 70 is provided with a pair of concave portions 72 at the back of a nozzle formation surface of a passage substrate 16 as shown in FIG. 16 and an electric signal input-output terminal 32 is provided on a heater element substrate 14 exposed by the concave portion 72. Therefore, a communicating port 26 provided to a common liquid chamber 22 of the head chip 70 is open in a direction perpendicular to an individual passage 20 (a direction shown by an arrow Z) and is open in a direction in which the individual passage 20 is extended (a direction shown by an arrow Y) between the pair of concave portions 72. Assuming that, of parts making up the communicating port 26, a part open in the direction shown by the arrow Z is a first opening 26D and a part open in the direction shown by the arrow Y is a second opening 26E, ink can be supplied to the common liquid chamber 22 from two perpendicular directions of the first opening 26D and the second opening 26E by mounting the head chip 70 to an ink supply member not shown, and the similar action and effect to those in the third embodiment are manufactured. Also, an electric signal input-output terminal 32 can be formed in a position which is not the ends in the longitudinal direction of the head chip 70 by providing the concave portion 72.

The positional relation with an ink tank or an ink subtank is not described, however, the configuration shown in the second and the third embodiments is desirable.

(Fifth Embodiment)

Figure 17:
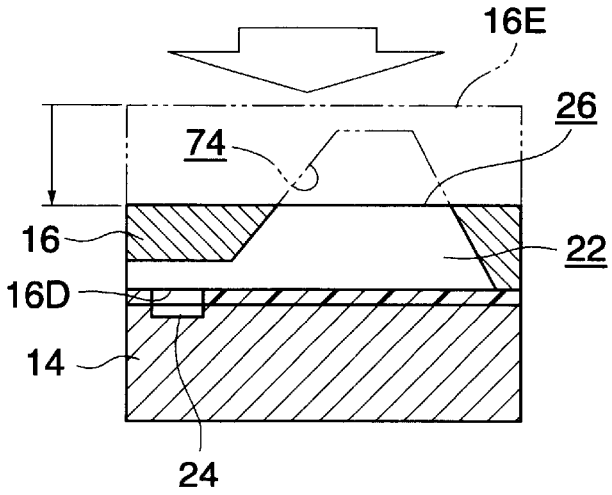
FIG. 17 is an explanatory drawing showing a method of producing a head chip equivalent to a fifth embodiment of the invention.

Referring to FIG. 17, a fifth embodiment of the invention will be described below. The same reference numbers are allocated to the same components for those in the first to the fourth embodiments and a detailed description is omitted.

In this embodiment, a method of producing a head chip 12 in which a communicating port 26 is open in one direction as shown in the first embodiment for example will be described.

First, a groove 74 not pierced in a passage substrate 16 from the side of a composition plane 16D by etching and others is formed and afterward, the passage substrate 16 and a heater element substrate 14 are joined. Next, the groove 74 is pierced by thinning the substrate from the composition plane 16D of the passage substrate 16 and the rear 16E on the reverse side by grinding or etching, and a common liquid chamber 22 and the communicating port 26 are formed. In this case, a process for grinding or etching from the rear 16E of the passage substrate 16 is executed after the passage substrate 16 and the heater element substrate 14 are joined, however, the process may also be executed before joining.

According to this embodiment, the groove can be stably pierced in a shorter time than the groove is pierced in the passage substrate 16 from the side of the composition plane 16D. Also, since the communicating port 26 can be largely formed in the same head chip size when the communicating port 26 is formed by ODE by thinning the substrate, the communicating port in size which allows bubbles to be exhausted can be acquired even if the chip size is reduced to enhance the yield of the heads. Further, a secondary effect is also acquired that a head chip dicing isolation process is facilitated because the substrate is thinned.

The positional relation with an ink tank is not described, however, the configuration described in the second and third embodiments is desirable. Also, in this embodiment, the common liquid chamber 22 has a shape that the rear side of the individual passage 20 is closed, however, the invention can also be applied to a head chip of a type shown in the second to fourth embodiments that the rear is open.

(Sixth Embodiment)

For a sixth embodiment of the invention, an example that the ink jet recording head equivalent to each of the above embodiments is combined with an ink feeder will be described below. The same reference numbers are allocated to the same components for those in the first to fifth embodiments and a detailed description is omitted.

Figure 18:
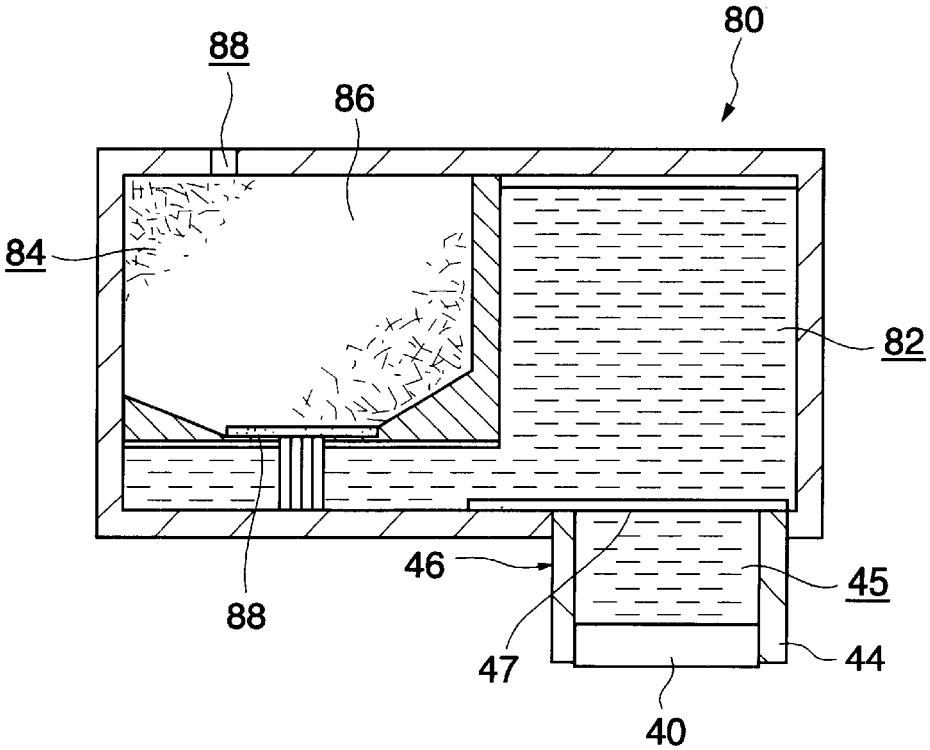
FIG. 18 is a sectional view showing an ink tank equivalent to a sixth embodiment of the invention.

As shown in FIG. 18, an ink feeder 80 is provided with a first ink chamber 82 in which ink with a free surface and a second ink chamber 84 for supplying ink to the first chamber 82 while controlling the negative pressure of the first ink chamber 82. In the second ink chamber 84, a porous member 86 in which ink is impregnated is arranged with the member open to the air and is connected to the first ink chamber 82 via a meniscus formation member 88.

The lower part of the first ink chamber 82 is connected to the ink subchamber 45 (the common liquid chamber 22) of the ink jet recording head 46 via the filter 47. Therefore, ink warmed by a heater element substrate 18 is circulated by convection in the ink subchamber 45 (the common liquid chamber 22) via the filter 47 and in the first ink chamber 82 and the outgoing radiation of the heater element substrate 18 can be more efficiently accelerated.

In an ink tank made up as described above, bubbles can be exhausted from the common liquid chamber 22 into the ink subchamber 45 without varying the posture of the head by setting at least one of ink supply passages to the common liquid chamber 22 in a range of approximately 45° in a gravitational direction. Preferably, as shown in FIG. 7, the growth of a bubble in the ink subchamber 45 can also be prevented by setting the position of the filter 47 to a gravitational direction or in a range of 45° for a communicating port 26.

In an ink supply system proposed in Japanese Patent Application Nos. Hei 11-320095 and Hei 11-350334 by the applicant, since gas in the first ink chamber 82 can be exhausted outside, the growth of a bubble in the ink tank can be prevented by the configuration described above and printing free of a defect caused by bubbles is semipermanently enabled.

In each of the above embodiments, only the case where one common liquid chamber 22 is provided in the ink jet recording head is described, however, the invention is not limited to this. If plural independent common liquid chambers 22 exist as in a plural color integrated ink jet recording head, a structure in which an ink tank and a communicating port (passage) are provided to each common liquid chamber has only to be applied.

Also, an ink jet recording head is not limited to that equivalent to the second embodiment and the invention can also be applied to the other embodiments or the ink jet recording heads shown in the conventional examples.

(Seventh Embodiment)

Figure 19:
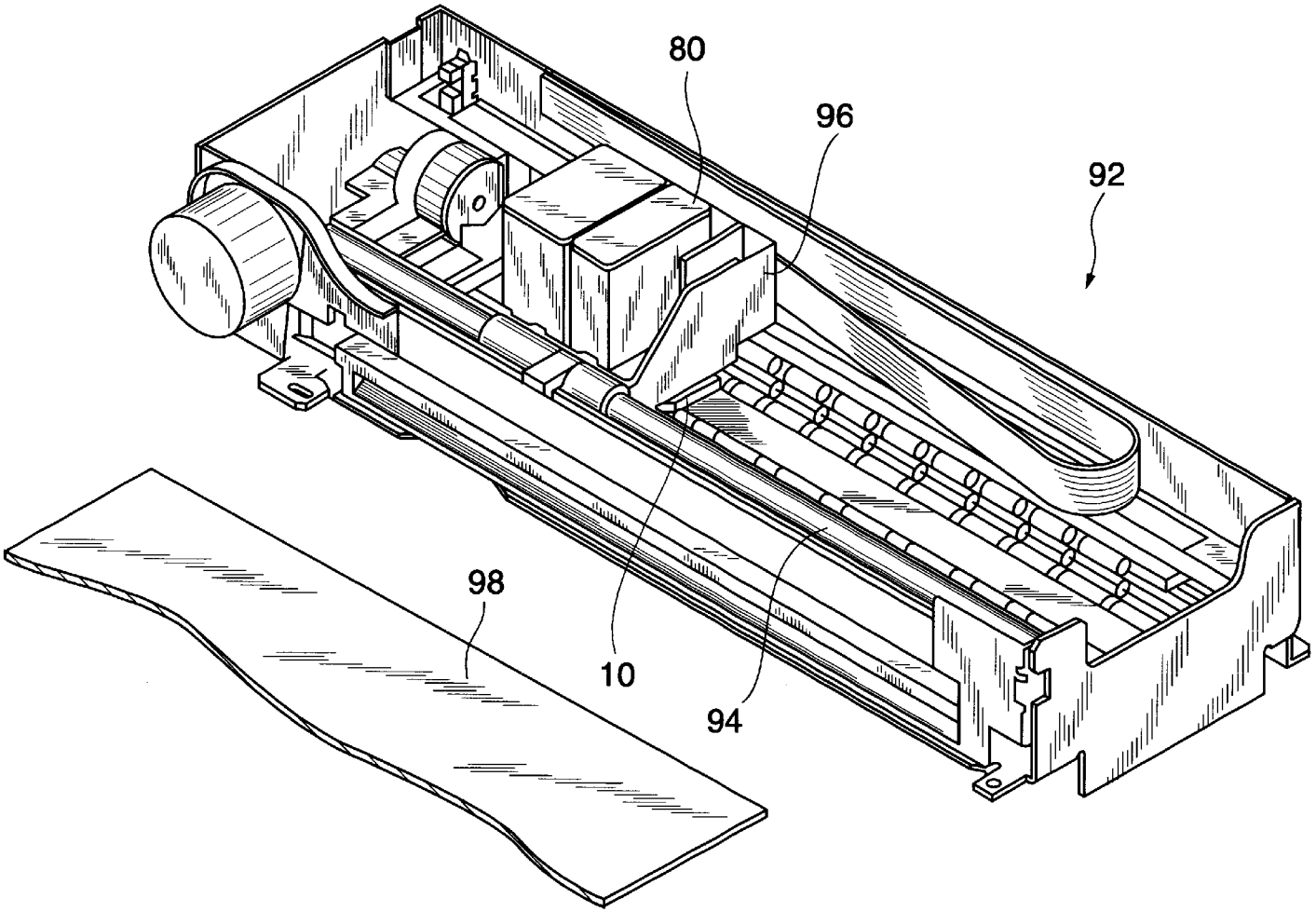
FIG. 19 is a perspective view showing an ink jet recording device equivalent to a seventh embodiment of the invention.
Figure 20:
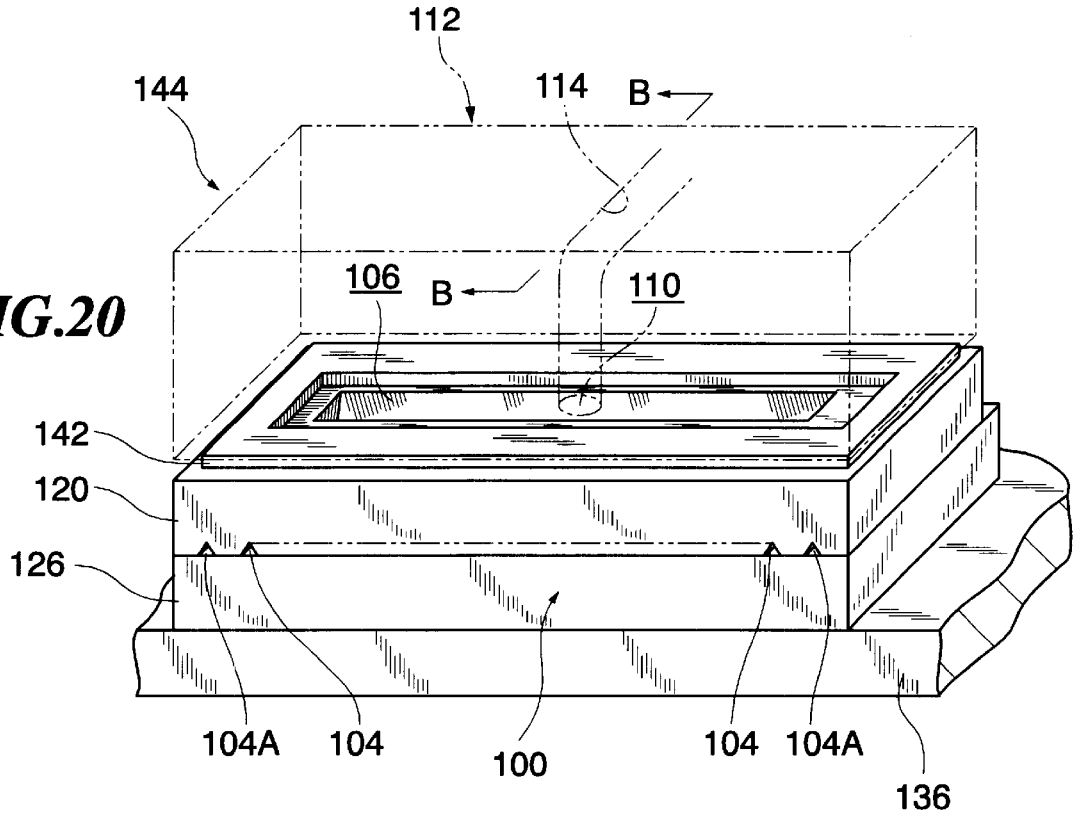
FIG. 20 is a perspective view showing a head chip and the vicinity of an ink supply member in a conventional example 1.
Figure 21:
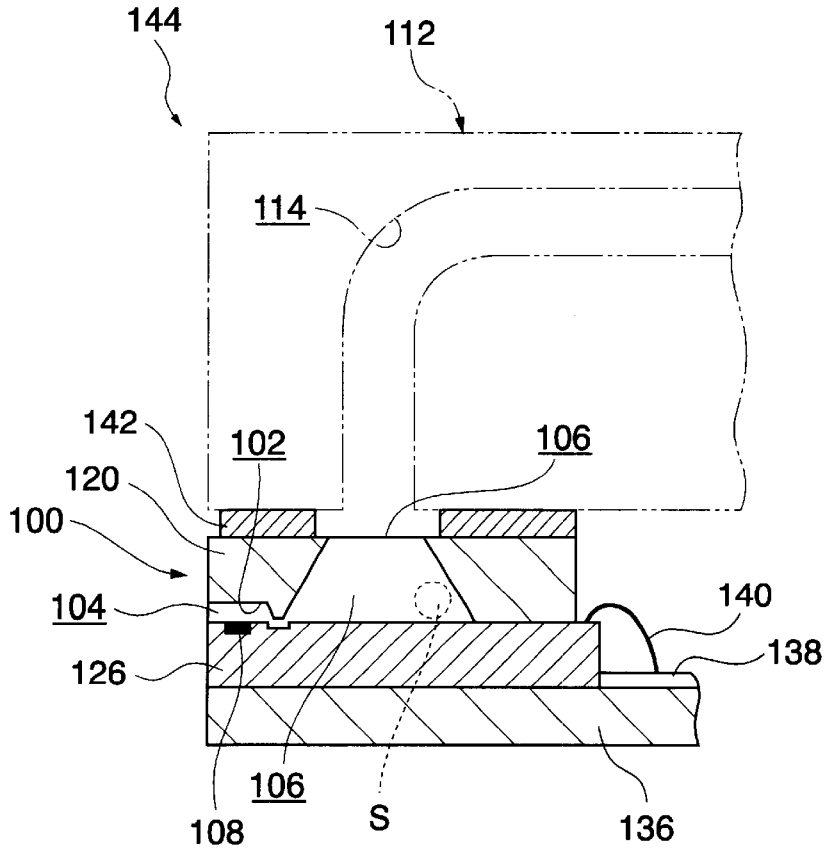
FIG. 21 is a sectional view viewed along the line B—B showing the head chip and the vicinity of the ink supply member in the conventional example 1.
Figures 22A, 22B, 22C, 22D, 22E, 22F:
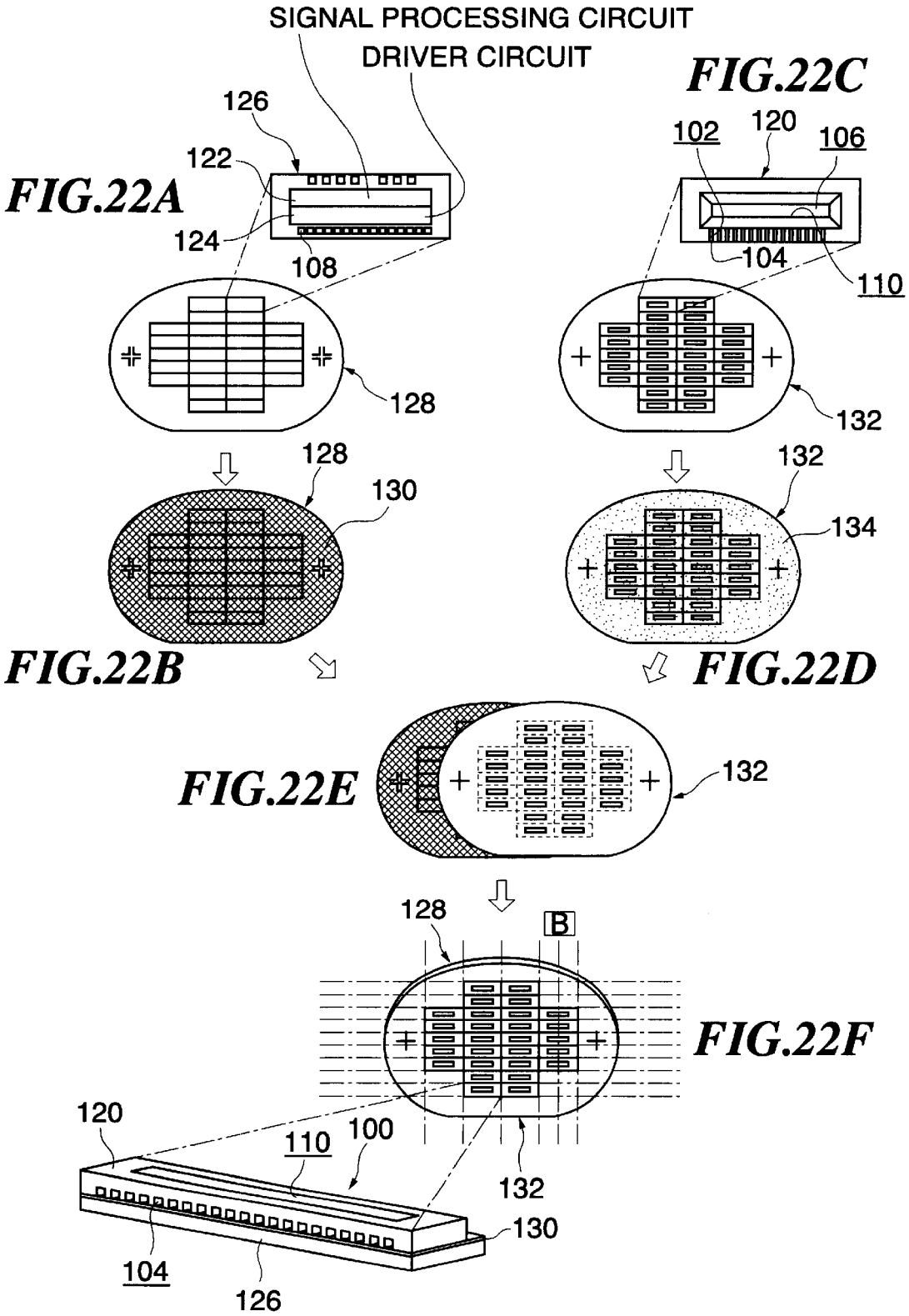
FIG. 22 are explanatory drawings showing the production processes of the head chip in the conventional example 1.
Figure 23:
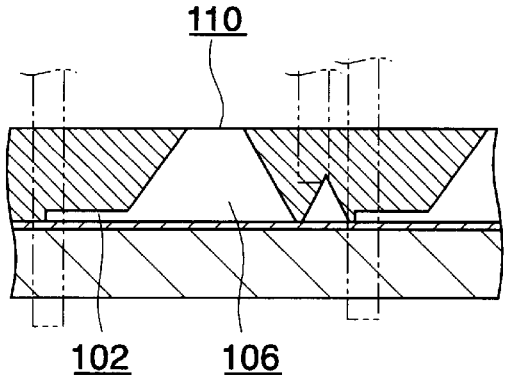
FIG. 23 is an explanatory drawing showing the production process of the head chip in the conventional example 1.
Figure 24:
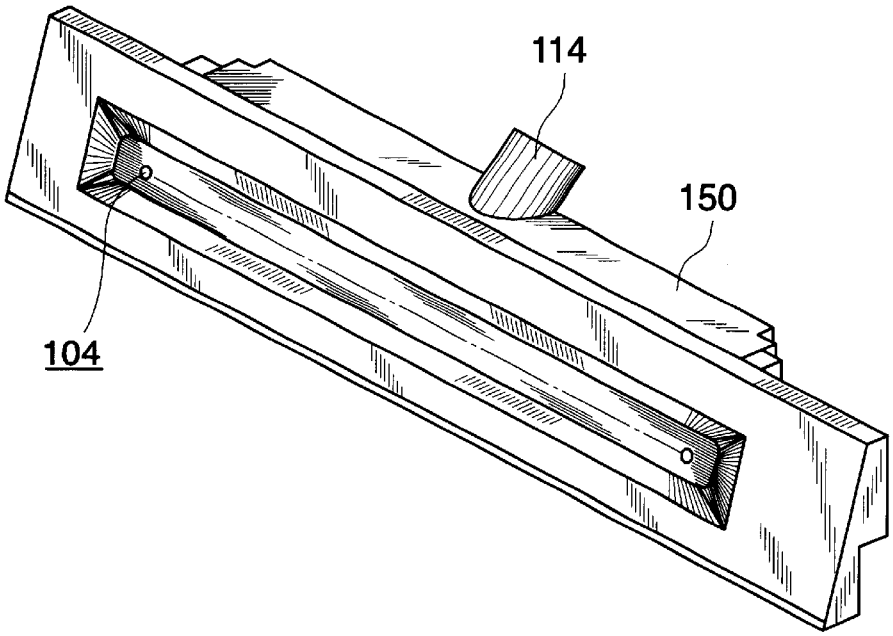
FIG. 24 is a perspective view showing the nozzle side of a nozzle top plate in a conventional example 2
Figure 25:
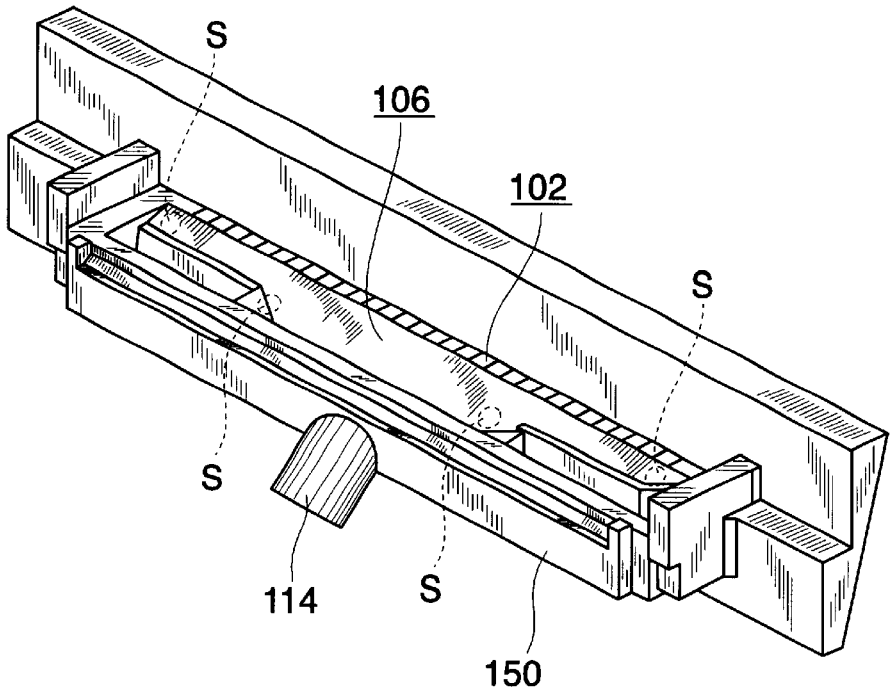
FIG. 25 is a perspective view showing the bonded side of the nozzle top plate in the conventional example 2.
Figure 26:
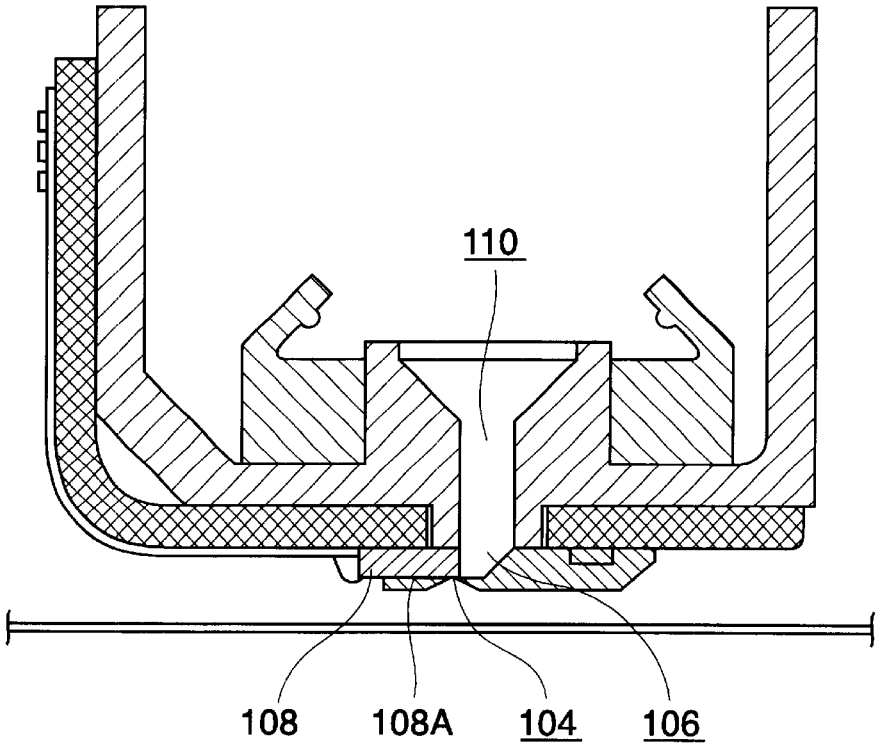
FIG. 26 shows the configuration of a head in a conventional example 3.
Figure 27:
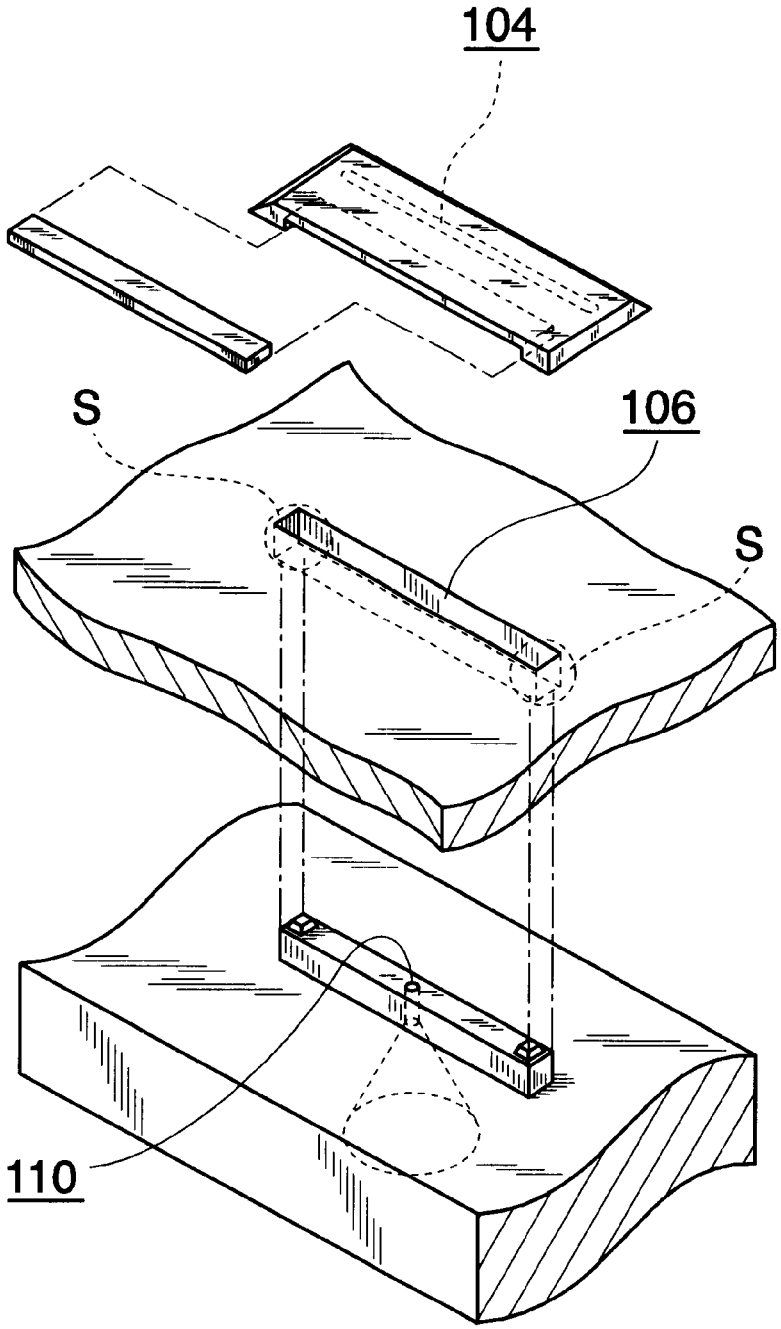
FIG. 27 is an exploded perspective view showing the head in the conventional example 3.

Referring to FIG. 19, a seventh embodiment of the invention will be described below. The same reference numbers are allocated to the same components for those in the first to sixth embodiments and a detailed description is omitted.

FIG. 19 is a schematic perspective view showing an example of an ink jet recording device mounting the ink jet recording head in each of the embodiments.

An ink jet recording device 92 is provided with an ink feeder 80 mounted on a carriage 96 along a guide shaft 94 and an ink jet recording head 10 (not limited to the first embodiment).

Since a bubble that stays in an individual passage 20 and a common liquid chamber 22 rises within the common liquid chamber 22 and leaves the vicinity of the individual passage 20 by installing the ink jet recording head 10 in the ink jet recording device 92 so that a direction in which ink is jetted from the ink jet recording head 10 is a gravitational direction or within 45 degrees from a gravitational direction, printing failure by bubbles can be stably prevented.

For a record medium 98, all the recordable media such as paper, a postal card and cloth are included. The record medium 98 is carried to a position corresponding to the ink jet recording head 10 by a carriage mechanism.

According to the invention, since a printing defect by bubbles in the ink jet recording head can be avoided, the suction of ink for exhausting bubbles is not required and the unnecessary consumption of ink can be inhibited. As a result, since the printing cost (the running cost) can be reduced and space for storing waste ink can be reduced, a printer itself can be miniaturized. Further, a document with a high printing rate which was impossible to print heretofore can also be continuously printed at high speed.

The entire disclosure of Japanese Patent Application No. 2000-133027 filed on May 1, 2000 including specification, claims, drawings and abstract is incorporated herein by reference in its entirety.

What is claimed is:

1. An ink jet recording head, comprising:

at least one individual passage communicating with a nozzle for jetting ink droplets;

a common liquid chamber communicating with each individual passage;

an ink chamber for supplying ink to the common liquid chamber; and a communicating passage connecting the common liquid chamber with the ink chamber, wherein:

when the jetting rate D of the ink jet recording head is D≧0.05, for a bubble having a diameter d that satisfies the following expression (1), the communicating passage having a minimum width L that satisfies the following expression (2) is formed:

$$\{(n\times V\times f\times D/S)^2\times Cd\times\rho\times\pi\times d^2\}/8<(\rho\times g\times\pi\times d^3)/6 \quad (1)$$

$$d<L \quad (2)$$

where n denotes the number of nozzles, V denotes the volume of an ink droplet jetted from the ink jet recording head, f denotes a maximum printing frequency, S denotes the minimum cross section of the communicating passage, Cd denotes a resistance coefficient, ρ denotes the density of ink and g denotes a gravitational constant.

2. An ink jet recording head according to claim 1, wherein:

the communicating passage has a curved part of less than 45°.

3. An ink jet recording head according to claim 1, further comprising plural communicating passages each of which connects one common liquid chamber to an ink chamber.

4. An ink jet recording head according to claim 1, wherein:

an ink droplet is jetted by heating the ink.

5. An ink jet recording head according to claim 4, comprising:

a heater element that heats ink; and a driving circuit that drives the heater element, wherein: the driving circuit is provided on the side of the common liquid chamber.

6. An ink jet recording head according to claim 1, wherein:

the ink chamber includes an ink supply member to which a head chip is fastened, the head chip being provided by mating a first substrate and a second substrate, and being provided with the individual passage and the common liquid chamber along the mating faces of the first substrate and the second substrate, and wherein one of the mated substrates is provided with a nozzle on one face and the communicating passage on the other face.

7. An ink jet recording head according to claim 6, wherein:

one of the substrates composing the head chip continues to the wall of an ink supply member forming the ink chamber.

8. An ink jet recording device, comprising:

the ink jet recording head according to claim 1.

9. An ink jet recording head, comprising:

at least one individual passage communicating with a nozzle for jetting ink droplets;

a common liquid chamber communicating with each individual passage;

an ink chamber for supplying ink to the common liquid chamber; and a communicating passage connecting the common liquid chamber with the ink chamber, wherein:

when the jetting rate D of the ink jet recording head is D≧0.05, for a bubble having a diameter d that satisfies the following expression (3), the communicating passage having the minimum cross section S that satisfies the following expression (4) is formed:

$$d\geqq 2Np \quad (3)$$

$$\{(n\times V\times f\times D/S)^2\times Cd\times\rho\times\pi\times d^2\}/8<(\rho\times g\times\pi\times d^3)/6 \quad (4)$$

where n denotes the number of nozzles, V denotes the volume of an ink droplet jetted from the ink jet recording head, f denotes a maximum printing frequency, Cd denotes a resistance coefficient, ρ denotes the density of ink, g denotes a gravitational constant and Np denotes pitch between nozzles.

10. An ink jet recording head, comprising:

at least one individual passage communicating with a nozzle for jetting ink droplets;

a common liquid chamber communicating with each individual passage;

an ink chamber for supplying ink to the common liquid chamber; and a communicating passage connecting the common liquid chamber and the ink chamber, wherein:

the communicating passage is formed to enable at least a bubble in size that causes a printing defect to be moved from the common liquid chamber to the ink chamber;

plural communicating passages each of which connects one common liquid chamber to a ink chamber are provided;

the recording head comprises k pieces of communicating passages, where k is an integer not less than 2, and when the jetting rate D of the ink jet recording head is $D \geqq 0.05$, for a bubble having a diameter d that satisfies the following expression (5), at least one communicating passage that satisfies the following expression (6) is formed:

$$\{((n \times V \times f \times D/S_i) \times (L_i^4/\Sigma L_i^4))^2 \times Cd \times \rho \times \pi \times d^2\}/8 < (\rho \times g \times \pi \times d^3)/6 \quad (5)$$

$$d < L_i \quad (6)$$

where n denotes the number of nozzles, V denotes the volume of an ink droplet jetted from the ink jet recording head, f denotes a maximum printing frequency, $S_i$ denotes the minimum cross section of an ith communicating passage, $L_i$ denotes the minimum width of the ith communicating passage, $\Sigma L_i^4$ denotes the sum of the fourth power value of the minimum width of all communicating passages ($=L_1^4+L_2^4+ \ldots +L_k^4$), Cd denotes a resistance coefficient, ρ denotes the density of the ink and g denotes a gravitational constant.

11. An ink jet recording head, comprising:

at least one individual passage communicating with a nozzle for jetting ink droplets;

a common liquid chamber communicating with each individual passage;

an ink chamber for supplying ink to the common liquid chamber; and a communicating passage connecting the common liquid chamber and the ink chamber, wherein:

the communicating passage is formed to enable at least a bubble in size that causes a printing defect to be moved from the common liquid chamber to the ink chamber;

plural communicating passages each of which connects one common liquid chamber to a ink chamber are provided;

the recording head comprises k pieces of communicating passages, where k is an integer not less than 2, and when the jetting rate D of the ink jet recording head is $D \geqq 0.05$, for a bubble having a diameter d that satisfies the following expression (7), at least one communicating passage that satisfies the following expression (8) is formed:

$$d \geqq 2Np \quad (7)$$

$$\{((n \times V \times f \times D/S_i) \times (L_i^4/\Sigma L_i^4))^2 \times Cd \times \rho \times \pi \times d^2\}/8 < (\rho \times g \times \pi \times d^3)/6 \quad (8)$$

where n denotes the number of nozzles, V denotes the volume of an ink droplet jetted from the ink jet recording head, f denotes a maximum printing frequency, $S_i$ denotes the minimum cross section of an ith communicating passage, $L_i$ denotes the minimum width of the ith communicating passage, $\Sigma L_i^4$ denotes the sum of the fourth power value of the minimum width of all communicating passages ($=L_1^4+L_2^4+ \ldots +L_k^4$), Cd denotes a resistance coefficient, ρ denotes the density of the ink, g denotes a gravitational constant and Np denotes pitch between nozzles.

12. An ink jet recording head, comprising:

at least one individual passage communicating with a nozzle for jetting ink droplets;

a common liquid chamber communicating with each individual passage;

an ink chamber for supplying ink to the common liquid chamber; and a communicating passage connecting the common liquid chamber and the ink chamber, wherein:

the communicating passage is formed to enable at least a bubble in size that causes a printing defect to be moved from the common liquid chamber to the ink chamber;

plural communicating passages each of which connects one common liquid chamber to a ink chamber are provided;

at least one of the plural communicating passages is provided upward in a gravitational direction in the common liquid chamber; and at least another one communicating passage is provided in a direction substantially perpendicular to an upward direction in a gravitational direction.

13. A method of manufacturing an ink jet recording head, comprising:

producing a heater element substrate with head units to which plural heater elements are provided;

producing plural passage substrates with head units in each of which an individual passage formed corresponding to one or plural heater elements for jetting ink droplets, a common liquid chamber for supplying ink to plural individual passages and plural communicating passages for supplying ink from an ink tank to the common liquid chamber are formed such that each of the plural communicating passages enables at least a bubble that causes a printing defect to be moved from the common liquid chamber to the ink tank; at least one of the plural communicating passages is provided upward in a gravitational direction in the common liquid chamber; and at least another one communicating passage is provided in a direction substantially perpendicular to an upward direction in a gravitational direction;

producing head chips by mating the heater element substrate and the passage substrate and dicing per head unit;

forming a nozzle on a first end face of a head chip;

forming an electrical signal input-output terminal on a second end face of the head chip opposite the first end face; and simultaneously forming an opening of the communication passage by the dicing step.

14. A method of manufacturing an ink jet recording head according to claim 13, wherein:

the passage substrate is produced by forming an individual passage and a common liquid chamber by applying reactive ion etching to a silicon substrate.

15. A method of manufacturing an ink jet recording head according to claim 13, wherein:

the passage substrate is produced by forming an individual passage and a common liquid chamber by applying anisotropic etching to a silicon substrate.

16. A method of manufacturing an ink jet recording head according to claim 15, wherein:

the common liquid chamber of the passage substrate is formed by forming from one side of the substrate a groove which does not reach the other side thereof, and then etching or grinding from the other side to make the groove run through the substrate.

* * * * *